US011821708B1

(12) United States Patent
Hansen et al.

(10) Patent No.: US 11,821,708 B1
(45) Date of Patent: Nov. 21, 2023

(54) AXLE ASSEMBLY FOR A BOW

(71) Applicant: Precision Shooting Equipment, Inc., Tucson, AZ (US)

(72) Inventors: Kevin L Hansen, Jefferson City, MT (US); Samuel S. Nevels, Marana, AZ (US)

(73) Assignee: Precision Shooting Equipment, Inc., Tucson, AZ (US)

( * ) Notice: Subject to any disclaimer, the term of this patent is extended or adjusted under 35 U.S.C. 154(b) by 0 days.

(21) Appl. No.: 17/740,043

(22) Filed: May 9, 2022

(51) Int. Cl.
*F41B 5/14* (2006.01)
*F41B 5/10* (2006.01)

(52) U.S. Cl.
CPC ..... *F41B 5/1403* (2013.01); *F41B 5/105* (2013.01); *F41B 5/148* (2013.01)

(58) Field of Classification Search
CPC ..... F41B 5/105; F41B 5/14; F41B 5/1403; F41B 5/148
USPC ..... 124/25.6, 86, 900
See application file for complete search history.

(56) References Cited

U.S. PATENT DOCUMENTS 4,064,862 A * 12/1977 Groner ..... F41B 5/105 124/900
4,333,443 A * 6/1982 Roelle ..... F41B 5/10 124/90
4,756,296 A * 7/1988 Darlington ..... F41B 5/105 124/900
5,390,655 A * 2/1995 Mitchell ..... F41B 5/105 124/90
6,415,780 B1 * 7/2002 Proctor ..... F41B 5/10 124/900
6,474,324 B1 * 11/2002 Despart ..... F41B 5/105 124/25.6
6,871,643 B2 * 3/2005 Cooper ..... F41B 5/105 124/900
6,964,271 B2 * 11/2005 Andrews ..... F41B 5/10 267/153
7,971,582 B1 * 7/2011 Larson ..... F41B 5/10 124/900
8,069,848 B1 * 12/2011 Larson ..... F41B 5/10 124/900
8,408,193 B2 * 4/2013 McPherson ..... F41B 5/105 124/25.6
8,528,534 B2 * 9/2013 McPherson ..... F41B 5/14 124/86
8,991,376 B2 * 3/2015 McPherson ..... F41B 5/10 124/1
9,115,953 B1 * 8/2015 Huang ..... F41B 5/105
9,528,788 B2 * 12/2016 McPherson ..... F41B 5/14
9,683,806 B1 * 6/2017 Yehle ..... F41B 5/105
10,126,087 B1 * 11/2018 Grace ..... F41B 5/123
10,371,480 B1 * 8/2019 Huang ..... F41B 5/10
11,486,674 B2 * 11/2022 McPherson ..... F41B 5/1403
11,536,532 B1 * 12/2022 Grace ..... F41B 5/1403
(Continued)

*Primary Examiner* — Alexander R Niconovich
(74) *Attorney, Agent, or Firm* — Merchant & Gould P.C.

(57) ABSTRACT

An axle assembly for a bow. The assembly includes spacers that can be used to adjust the position of a rotatable member axially along an axle that supports the rotatable member. The spacers can each have a snap-on configuration and can be installed and removed from the axle using an installation tool. The rotatable member can be mounted on the axle by a bearing assembly, and the axle assembly can include features for preventing thrust load from being applied to the bearing assembly.

26 Claims, 23 Drawing Sheets

(56) References Cited

U.S. PATENT DOCUMENTS

| | | | | |
|---|---|---|---|---|
| 2008/0029075 | A1* | 2/2008 | McMurray | F41B 5/10 124/25.6 |
| 2020/0158461 | A1* | 5/2020 | Romero | F41B 5/105 |
| 2023/0113520 | A1* | 4/2023 | Grace | F41B 5/105 124/25.6 |

* cited by examiner

AXLE ASSEMBLY FOR A BOW

TECHNICAL FIELD

The present disclosure relates generally to archery equipment. More particularly, the present disclosure relates to axle assemblies for supporting rotatable cams of compound bows.

BACKGROUND

Tuning a compound bow is a process in which the bow is very deliberately and specifically set up to maximize performance. Bow tuning takes into account a number of factors including differences from bow to bow resulting from manufacturing tolerances, the basic bow setup (e.g., draw length) including aftermarket accessories mounted to the bow (arrow rest, stabilizers, sight, etc.) and shooter's shooting variables (shooting technique, type of release used, shooter's physical characteristics (e.g., hand size, facial characteristics such as nose eye alignment, etc.))

One common aspect of tuning a bow includes adjusting the lateral position of a rotatable member such as a cam along the axle that supports the rotatable member. Traditionally, adjusting the lateral position of a rotatable member on its axle is accomplished by adding and removing spacers on either side of the rotatable member. The spacers are typically washer shaped structures that slide over the end of the axle. This tuning process typically involves disassembling the axle assembly, adding and removing spacers onto the axle on either side of the rotatable member and then reassembling the bow. Once reassembled the bow is tested (e.g., paper tuned) and spacers may be further adjusted as needed. This type of bow tuning is iterative, laborious, time intensive and necessitates the use of a specialized equipment.

SUMMARY OF THE DISCLOSURE

One aspect of the present disclosure relates to a system and method for efficiently and easily tuning a bow. More particularly, the system and method relate to an axle assembly including spacers such as snap-on spacers that can be used to adjust the position of a rotatable member such as a cam or pulley axially along an axle shaft that supports the rotatable member. In certain examples, the snap-on spacers can have features that facilitate inserting the spacers onto the axle shaft with a tool and that facilitate removing the spacers from the axle shaft with the tool. In certain examples, the tool can engage the spacers without clamping the spacers. In certain examples, the spacers can be elongate along lengths of the spacers, and the tool can engage tool interface ends of the spacers that are opposite from snap-on portions of the spacers. In certain examples, when mounted on the axle shaft, each spacer can be configured to oppose a portion (e.g., a limb) of the bow to prevent the spacers from rotating on the axle shaft. In certain examples, the spacers can be mounted on the axle shaft with open sides of the spacers facing away from a sight line of the bow to reduce the likelihood of the spacers disengaging from the axle shaft during shooting. The system and method of the present disclosure avoids the need to disassemble the bow or axle assembly to add or remove spacers. In the depicted embodiments, the spacers of the system and method can be inserted and removed without access to either of the distal ends of the axle shaft.

Another aspect of the present disclosure relates to an axle assembly for a bow. The axle assembly is configured to limit an amount first and second limbs of the bow can be drawn together during assembly of the axle assembly with respect to the bow. In certain examples, the configuration prevents thrust loading from being applied to a bearing which supports a rotatable member (e.g., a cam or pulley) on an axle shaft of the axle assembly or limits that amount of thrust load applied. In certain examples, the axle assembly establishes a pre-determined spacing between the first and second limbs when the axle assembly is fully tightened. In one example, the configuration includes limb sleeves that interact with the axle shaft and the first and second limbs to limit an amount first and second limbs of the bow can be drawn together during assembly of the axle assembly with respect to the bow. In another example, the configuration includes snap-on stops (e.g., clips) that snap within grooves defined by the axle shaft to limit an amount first and second limbs of the bow can be drawn together during assembly of the axle assembly with respect to the bow.

DETAILED DESCRIPTION

Figure 1:
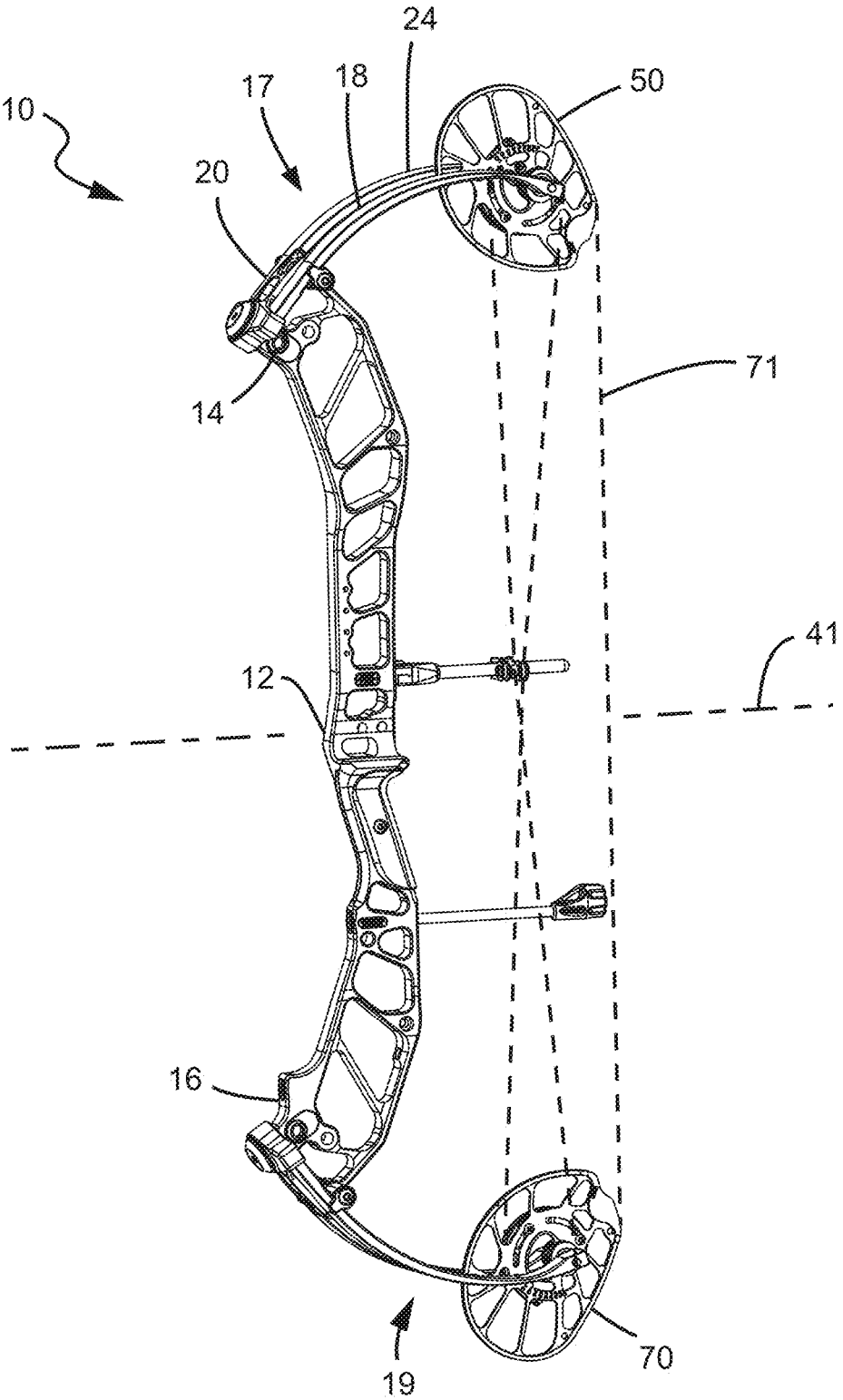
FIG. 1 is a side view of an embodiment of an archery bow according to the principles of the present disclosure.

Referring to the FIGS. 1-6, the present disclosure provides an embodiment of an archery bow 10 according to the principles of the present disclosure. The bow 10 includes a riser 12 that includes a first end portion 14 and a second end portion 16. The bow includes a first limb arrangement 17 including a first limb 18 and a second limb 24. The first limb 18 includes a first end portion 20 and a second end portion 22. The first end portion 20 of the first limb 18 is connected to the first end portion 14 of the riser 12. The second limb 24 includes a first end portion 26 and a second end portion 28. The first end portion 26 of the second limb 24 is connected to the first end portion 14 of the riser 12. It should be appreciated that alternative configurations are also possible (e.g., forked limb configurations).

In the depicted embodiment, the bow 10 includes a first axle assembly 30 including a first limb sleeve 32 received in an aperture 34 in the second end portion 22 of the first limb 18. The bow 10 includes a second limb sleeve 36 received in an aperture 38 in the second end portion 28 of the second limb 24. It should be appreciated that alternative configurations are also possible. Some alternative embodiments will be discussed in further detail below.

Figure 2:
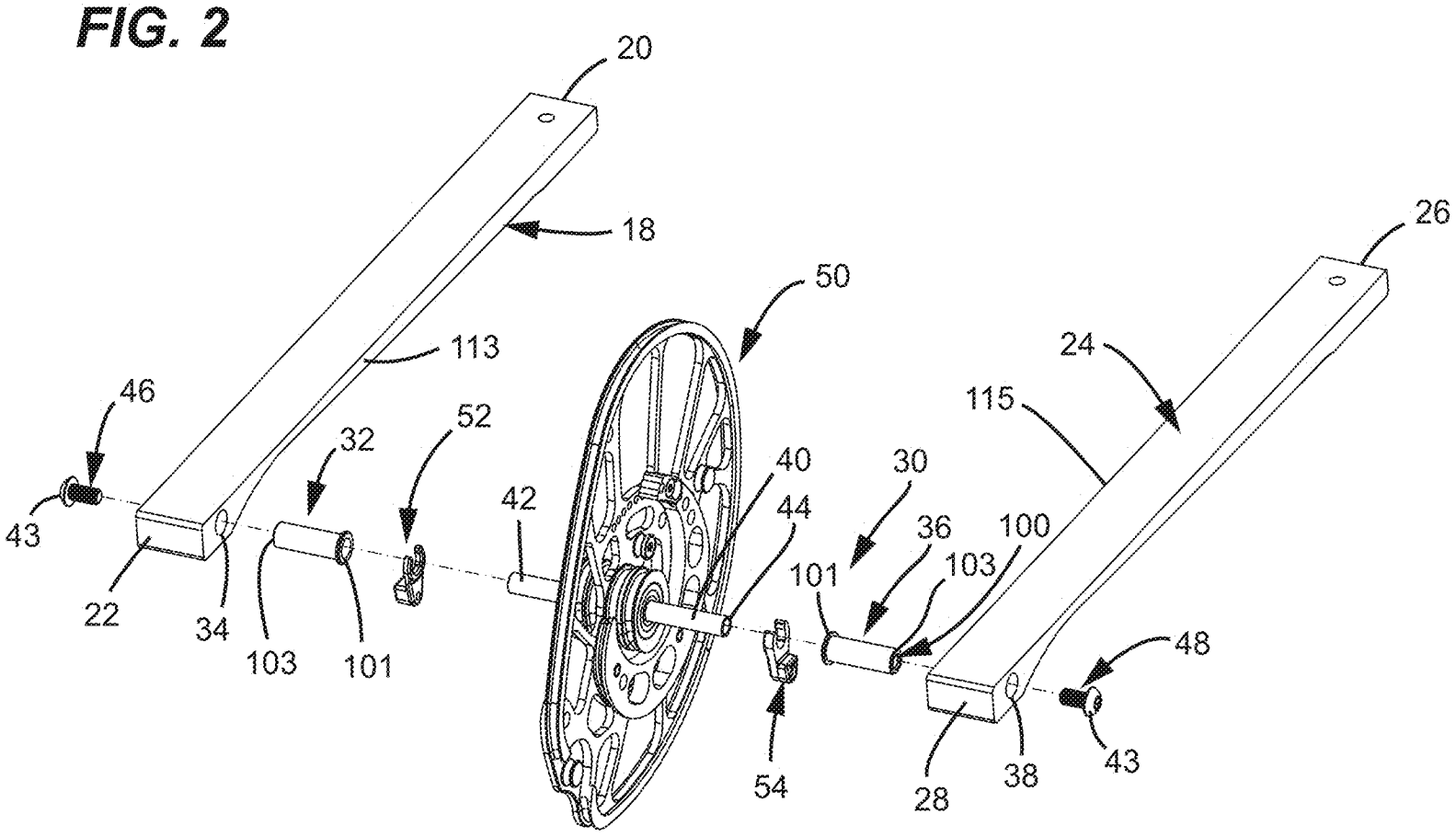
FIG. 2 is an exploded assembly view of a portion of the bow of FIG. 1.
Figure 3:
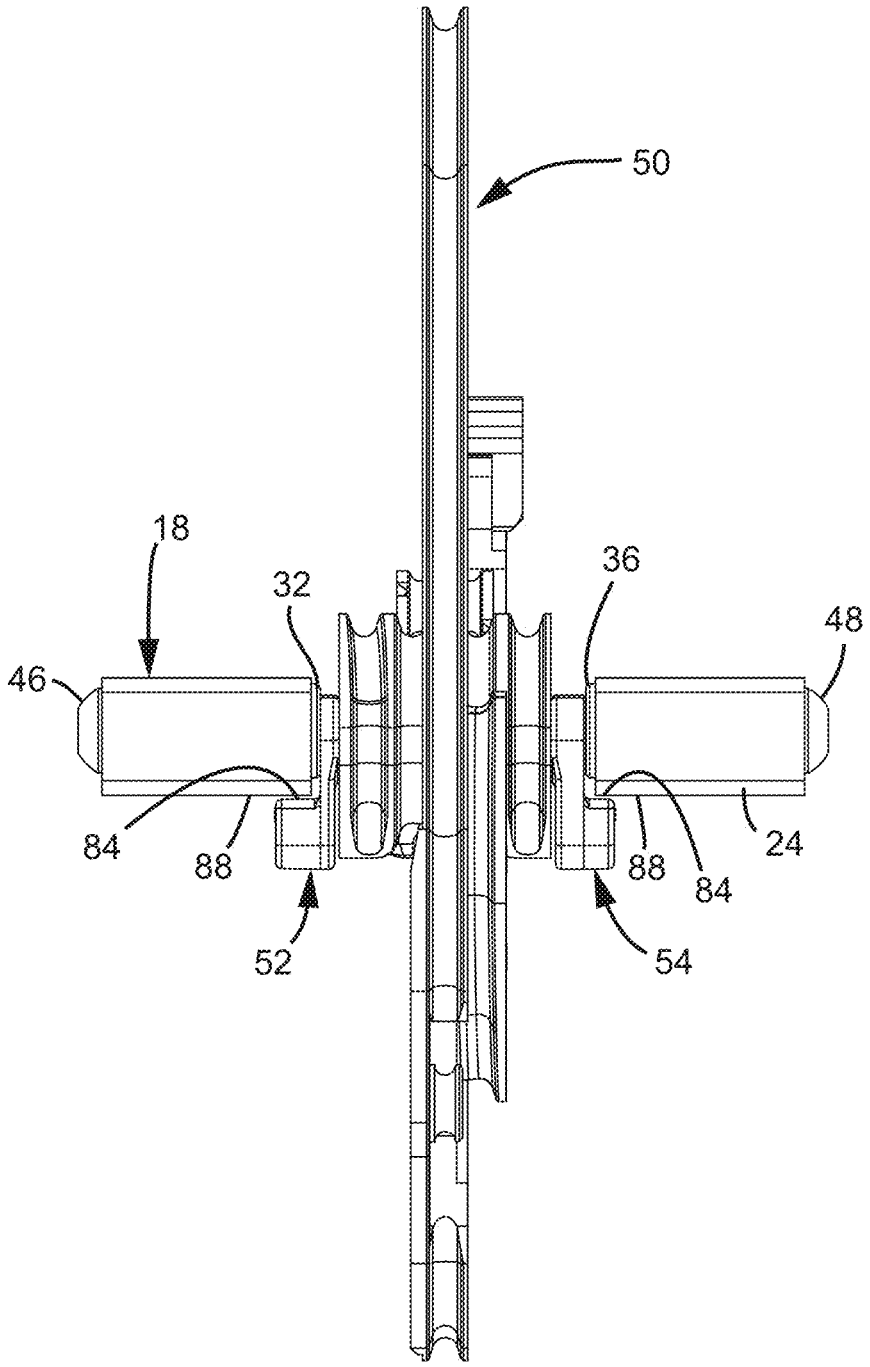
FIG. 3 is an end view of a portion of the bow of FIG. 1.
Figure 4:
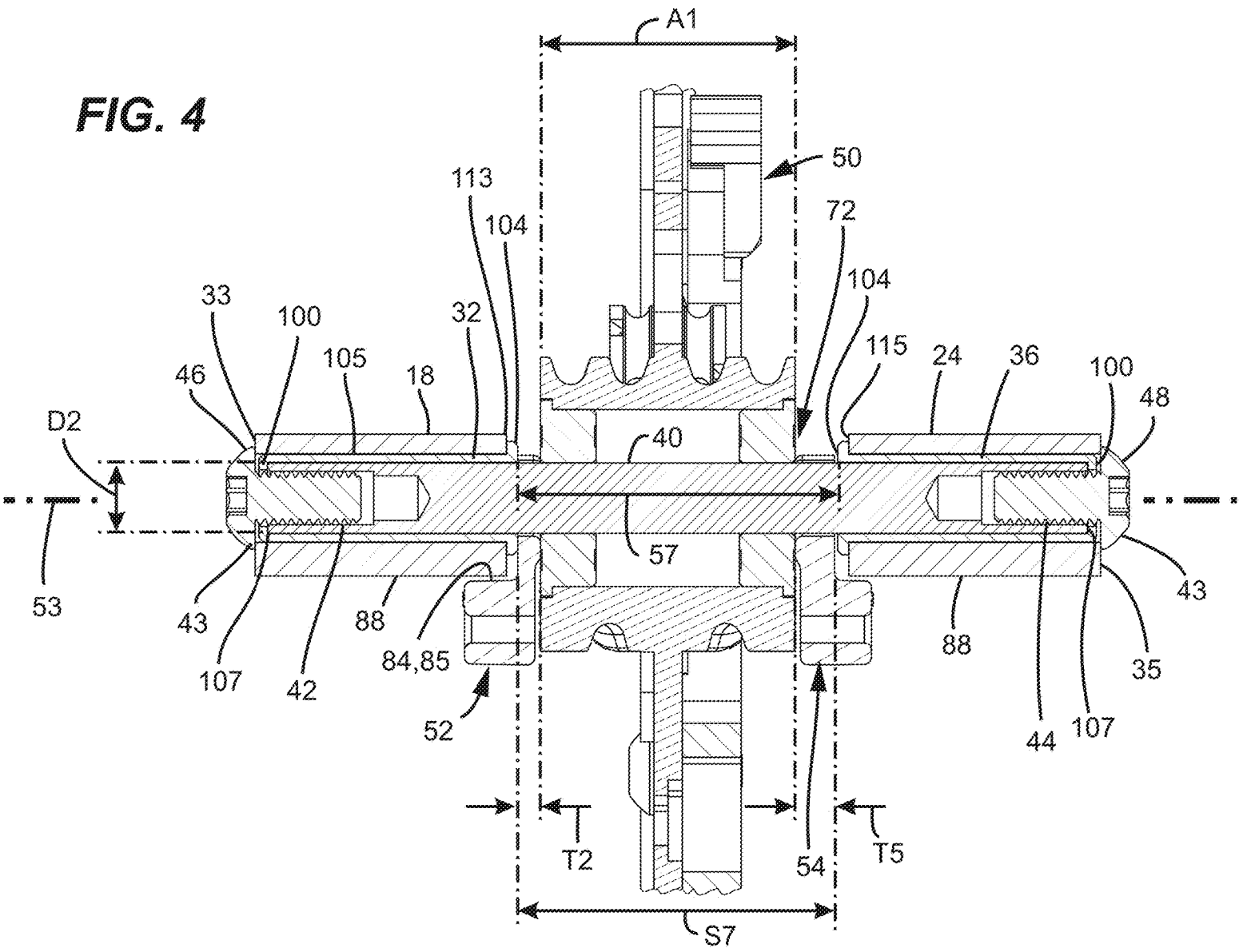
FIG. 4 is a cross sectional view of the structure depicted in FIG. 3.
Figure 5:
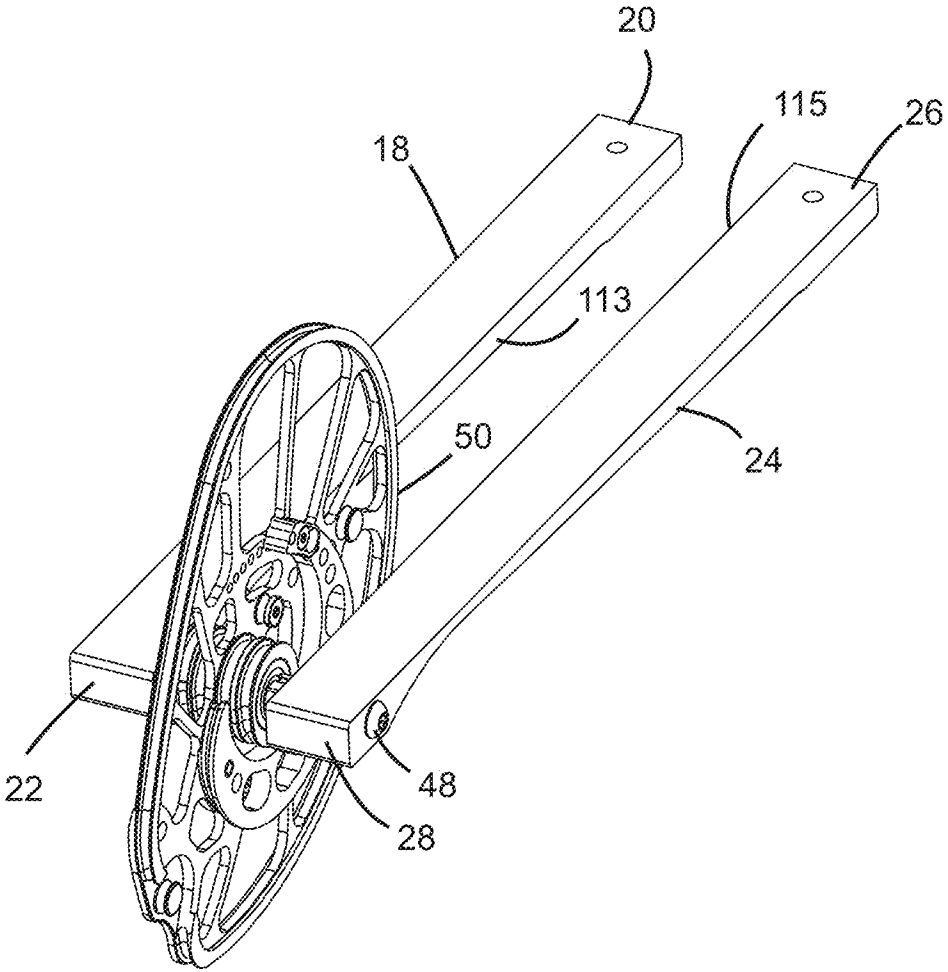
FIG. 5 is an isometric view of a portion of the bow of FIG. 1.

Referring to FIGS. 2 and 4, the first axle assembly 30 of the bow 10 includes an axle shaft 40. The axle shaft 40 includes a first threaded end portion 42 and a second threaded end portion 44. The threaded end portions 42, 44 are depicted an internally threaded portions of the axle shaft 40. The first threaded end portion 42 is received in the first limb sleeve 32 and the second threaded end portion 44 is received in the second limb sleeve 36. In the depicted embodiment, a first threaded fastener 46 (e.g., a screw) extends though the first limb sleeve 32 and is engaged with threads in the first threaded end portion 42 of the axle shaft 40. A second threaded fastener 48 (e.g., a screw) extends though the second limb sleeve 36 and is engaged with thread in the second threaded end portion 44 of the axle shaft 40. Heads 43 of the threaded fasteners 46, 48 oppose outer lateral sides 33, 35 (e.g., left and right lateral outer sides as shown at FIG. 4) of the limbs 18, 24 to draw the limbs 18, 24 toward each other as the threaded members 46, 48 are threaded into the threaded ends of the axle shaft 40. The outer lateral sides 33, 35 are transverse with respect to an axis 53 of the axle shaft 40. It should be appreciated that alternative configurations are also possible.

In the depicted embodiment, a first rotatable member 50 is supported for rotation on the axle shaft 40. In the depicted embodiment a first spacer member 52 is secured to the axle shaft located between the first rotatable member 50 and the first limb 18. A second spacer member 54 is secured to the axle shaft 40 located between the first rotatable member 50 and the second limb 24. In the depicted embodiment the first and second spacers 52, 54 are configured to be secured to the first axle shaft 40 while the axle shaft 40 is secured to the first limb 18 and second limb 24.

Referring to FIG. 1, the bow 10 includes a second limb assembly 19 to which a second rotatable member 70 is secured by a second axle assembly. The second limb assembly 19 can be secured to the second end portion 16 of the riser 12. It will be appreciated that the second limb assembly 19, the second rotatable member 70 and the second axle assembly can have the same configuration as the first limb assembly 17, the first rotatable member 50 and the first axle assembly. However, the second limb assembly 19, the second rotatable member 70 and the second axle assembly are symmetrically arranged with respect to the first limb assembly 17, the first rotatable member 50 and the first axle assembly generally about a horizontal plane that bisects the bow. To avoid redundancy, detailed descriptions of the second limb assembly 19, the second rotatable member 70 and the second axle assembly are not separately provided. It should be appreciated that in other examples the first and second axle assemblies could be different from each other. In the depicted embodiment first rotatable member 50 is a cam and the second rotatable member 70 is also a cam. The rotatable members 50, 70 engage a bow string 71 routed about the rotatable members 50, 70. It should be appreciated that other configurations are possible.

In the depicted example, the first and second rotatable members 50, 70 are rotatably supported on their respective axle shafts (e.g., axle shaft 40 for the first rotatable member 50) by a bearing assembly 72 (see FIG. 4). Referring to FIG. 4, the bearing assembly 72 defines an axial dimension A1 measured along an axis of its corresponding axle shaft (e.g., the axis 53 of axle shaft 40, as depicted).

In the depicted embodiment, a spacing adjustment kit 200 (see FIG. 18) can be used to set the rotatable member 50 at a desired axial position between inner lateral sides 113, 115 of the limbs 18, 24. It will be appreciated that the axial position can be offset from a center position between the inner lateral sides 113, 115. The kit 200 can include a number of spacer members that share the same configuration but differ in effective thickness. For example, the first spacer member 52 and the second spacer member 54 have the same basic construction, but different effective thicknesses. It will be appreciated that additional spacers having different effective thicknesses can also be provided in a kit. The spacer members can be used in sets with different sets being configured to position the rotatable members 50, 70 at different lateral offset distances from a center of a spacing between the limbs. Each set of spacer members preferably provide the same total spacing dimension, but different sets can be selected to vary the amount of the total spacing dimension that is provided on the left and right sides of the rotatable members 50, 70.

Figure 18:
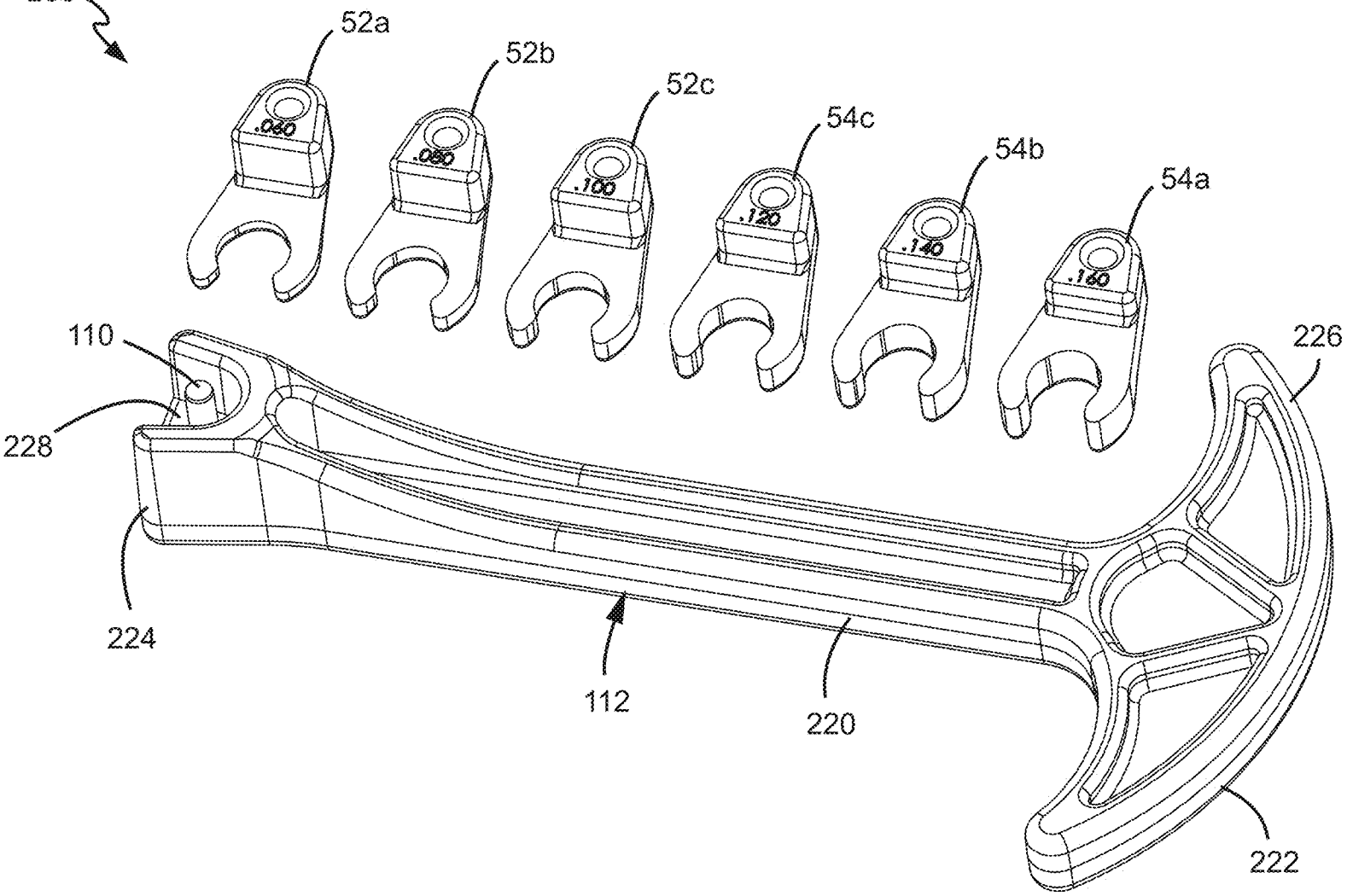
FIG. 18 is a perspective view of a spacer kit in accordance with the principles of the present disclosure.
Figure 19:
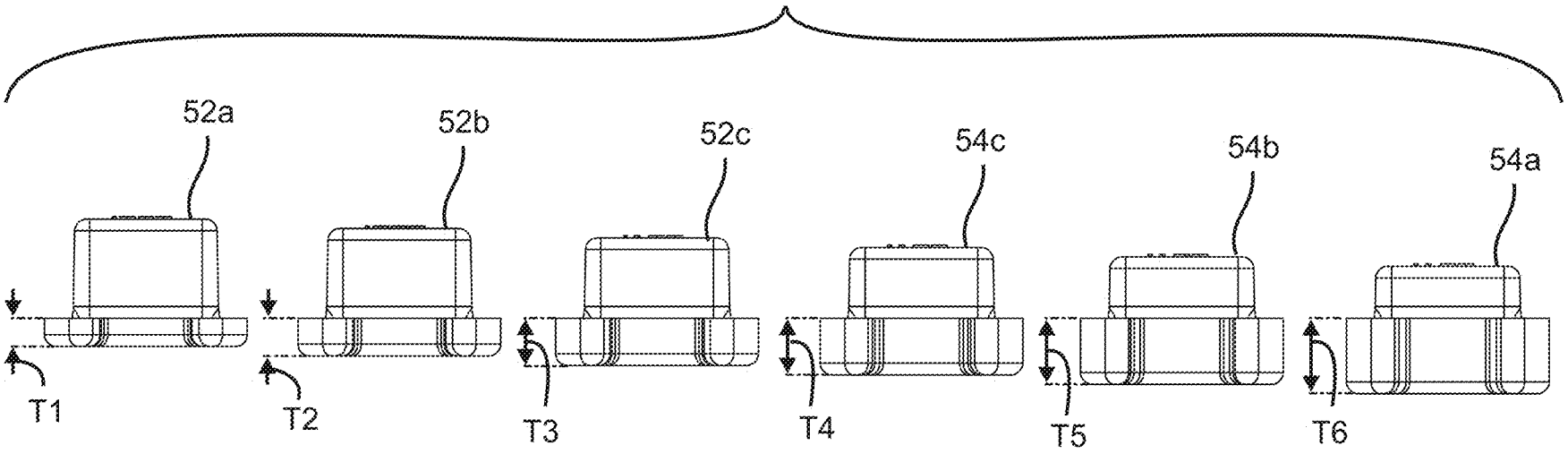
FIG. 19 is a view comparing the spacing thicknesses of the spacers of the spacer kit of FIG. 18.
Figure 20:
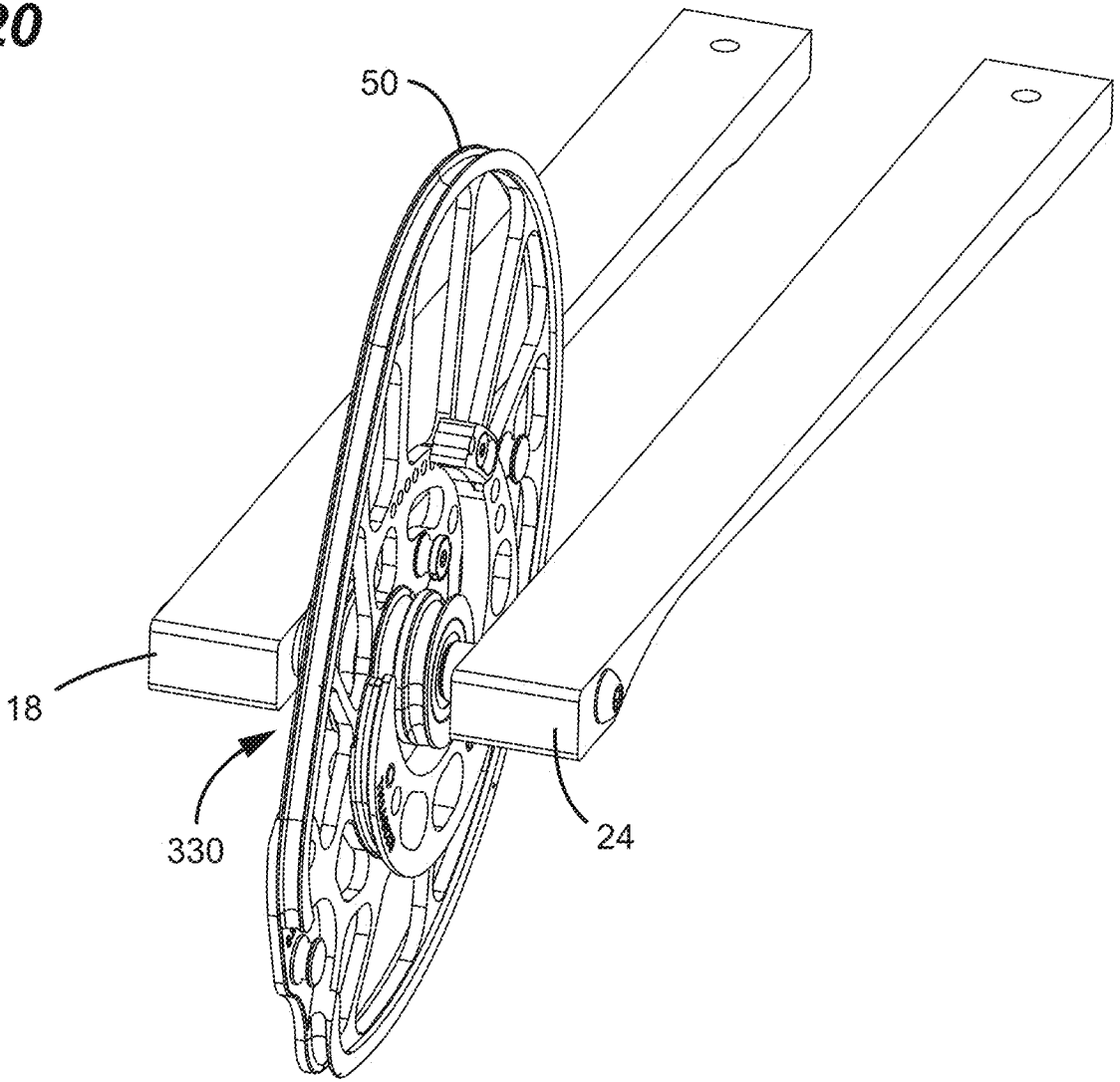
FIG. 20 is a perspective view of another axle assembly in accordance with the principles of the present disclosure for supporting a rotatable member of a bow.
Figure 21:
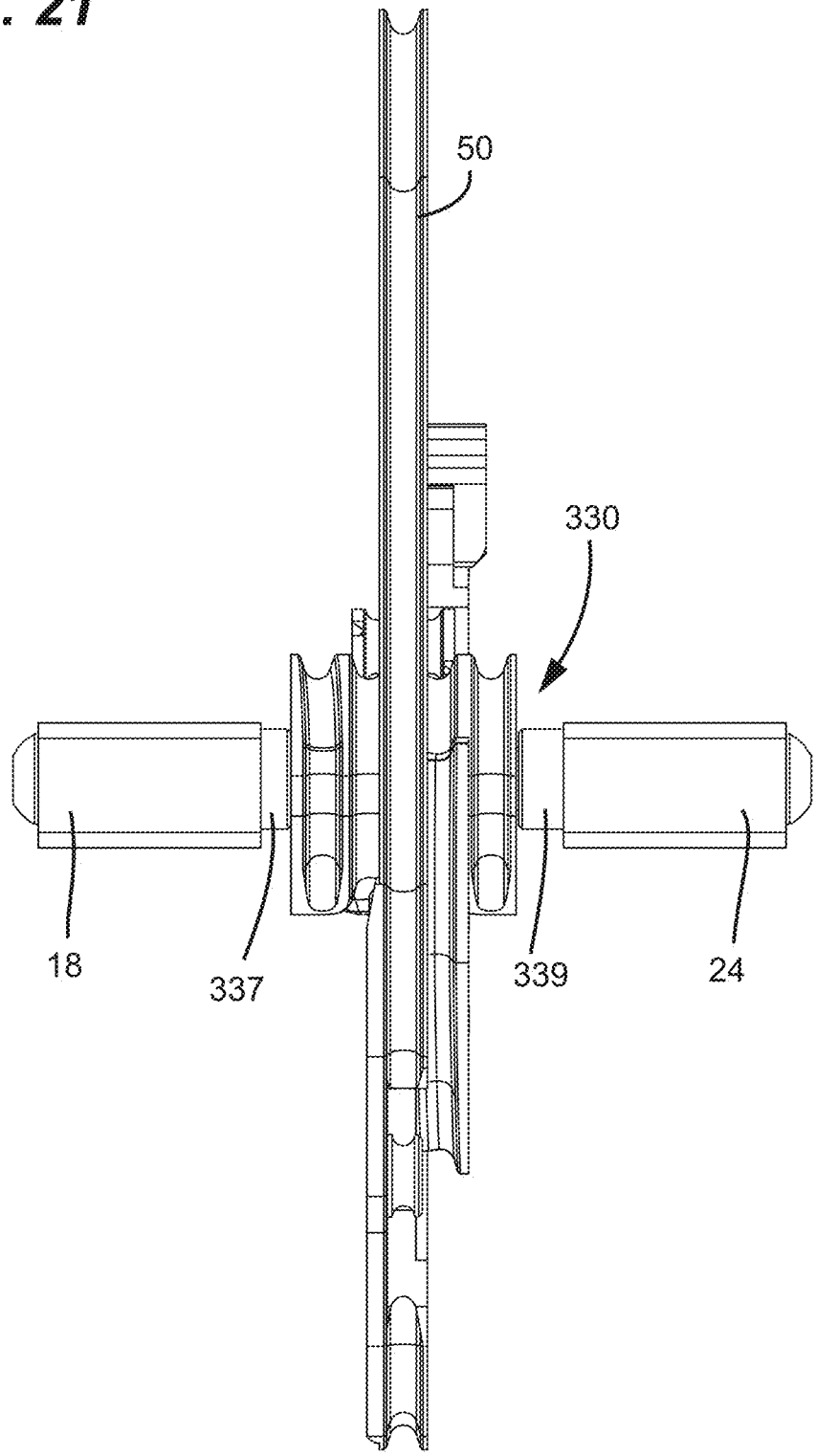
FIG. 21 is an end view of the axle assembly of FIG. 20.
Figure 22:
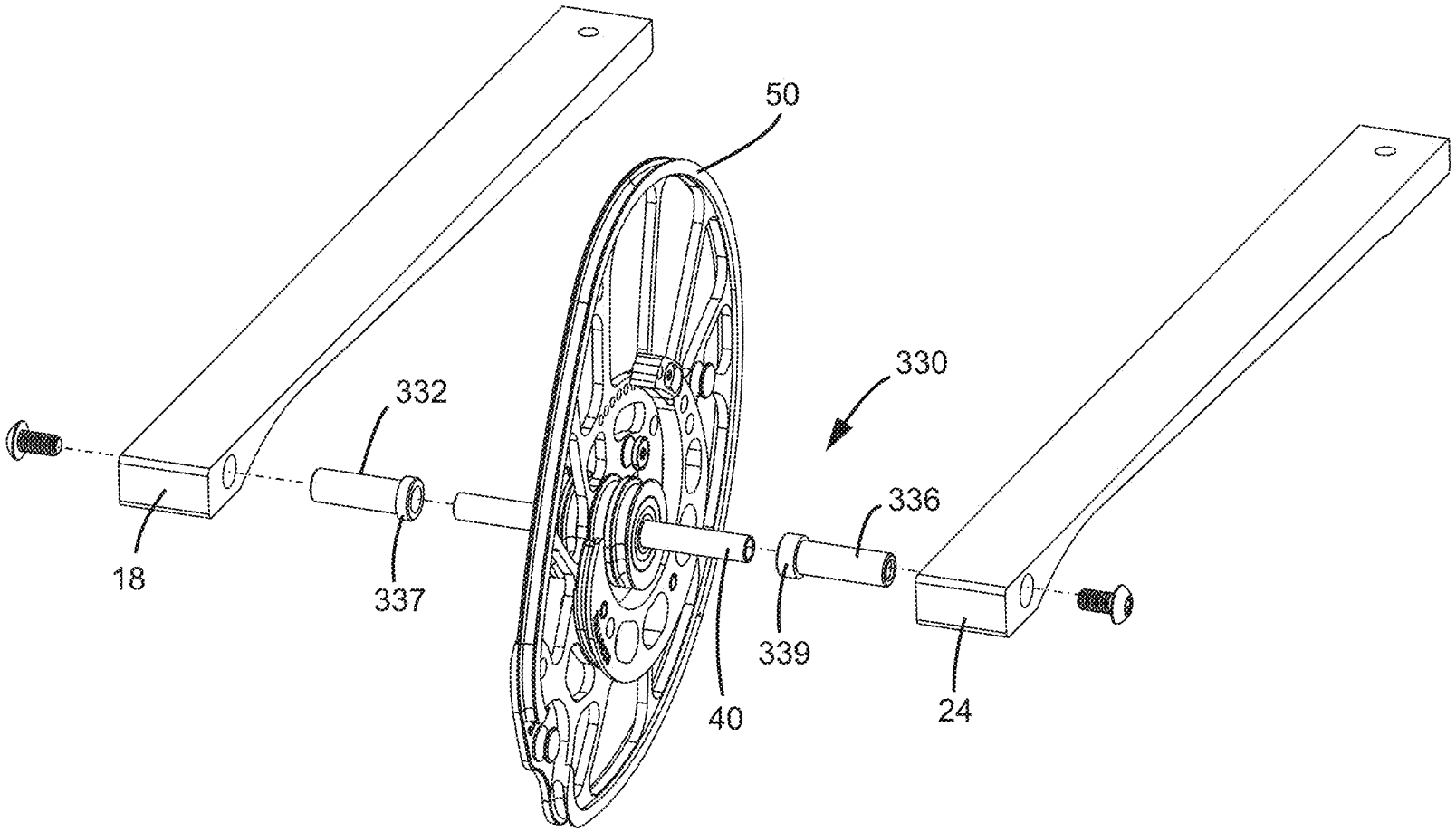
FIG. 22 is an exploded view of the axle assembly of FIG. 20.
Figure 23:
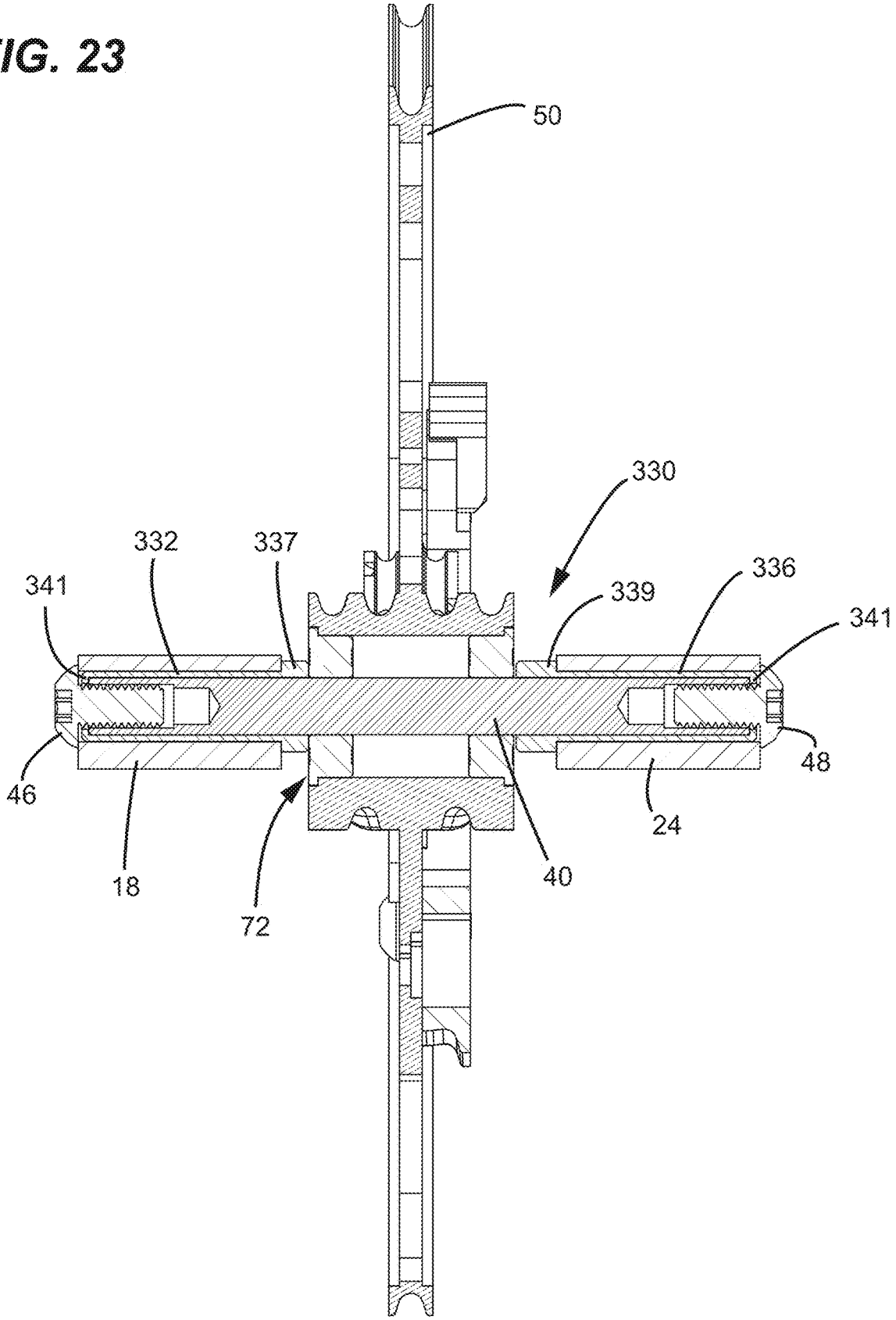
FIG. 23 is a cross-sectional view of the axle assembly of FIG. 20.

Referring to FIG. 18, the kit 200 includes a tool 112 for installing the spacers on the axle shaft 40 and for removing the spacers from the axle shaft 40. The spacer kit 200 includes a plurality of spacers having different effective spacing thicknesses. The spacers include: a first set of spacers including a first spacer 52*a* and a second spacer 54*a*; a second set of spacers including a first spacer 52*b* and a second spacer 54*b*; and a third set of spacers including a first spacer 52*c* and a second spacer 54*c*. The first and second spacers of each set of spacers can be mounted on the axle shaft 40 interchangeably at the left or right side of the bearing assembly 72 depending on whether is desired to offset the rotatable members 50, 70 to the left or right of center between the limbs 18, 24. The spacers 52*a*, 52*b*, 52*c*, 54*a*, 54*b* and 54*c* have different spacing thicknesses. For example, spacer 52*a* has a spacing thickness T1 and its corresponding paired spacer 54*a* has a spacing thickness T6. The spacer set 52*a*, 54*a* provides a maximum spacing difference between the spacers 52*a*, 54*a* to provide a maximum offset of the rotatable member from center when the spacer set 52*a*, 54*a* is selected. The spacer 52*b* has a spacing thickness T2 and its corresponding paired spacer 54*b* has a spacing thickness T5. The spacer set 52*b*, 54*b* provides an intermediate spacing difference between the spacers 52*b*, 54*b* to provide an intermediate offset of the rotatable member from center when the spacer set 52*b*, 54*b* is selected. The spacer 52*c* has a spacing thickness T3 and its corresponding paired spacer 54*c* has a spacing thickness T4. The spacer set 52*c*, 54*c* provides a minimum spacing difference between the spacers 52*c*, 54*c* to provide a minimum offset of the rotatable member from center when the spacer set 52*b*, 54*b* is selected. The spacing thicknesses T1-T6 progressively increase in magnitude. The number of spacer sets provided and the values of the spacings can vary. The total spacing dimension provided by each set of the spacers generally equals a spacing S7 defined between the inner ends of the limb sleeves 32, 36 minus the axial dimension A1 of the bearing assembly 72 when the axle assembly is fully tightened. In the depicted example, the spacing thickness T1 of spacer 52*a* equals 0.06 inches and the spacing thickness T6 of the paired spacer 54*a* equals 0.16 inches for a total spacing of 0.22 inches and an axial offset distance of 0.1 inches. In the depicted example, the spacing thickness T2 of spacer 52*b* equals 0.08 inches and the spacing thickness T5 of the paired spacer 54*b* equals 0.14 inches for a total spacing of 0.22 inches and an axial offset distance of 0.06 inches. In the depicted example, the spacing thickness T3 of spacer 52*c* equals 0.1 inches and the spacing thickness T4 of the paired spacer 54*c* equals 0.12 inches for a total spacing of 0.22 inches and an axial offset distance of 0.2 inches. Of course, the numerical values provided are examples and can be varied. It will be appreciated that first and second spacers 52 and 54 of FIGS. 2-4 correspond to spacer set 52*b*, 54*b*.

In certain examples, spacer members in accordance with the principles of the present disclosure can have a molded plastic construction such as a molded Nylon construction. In other examples, other materials can be used to construct the spacers.

It will be appreciated that aside from the differences in thicknesses T1-T6, spacers in accordance with the present disclosure can have similar structure features. Hence, for the purposes of this disclosure, such features will only be described with respect to the spacer member 52.

Figure 6:
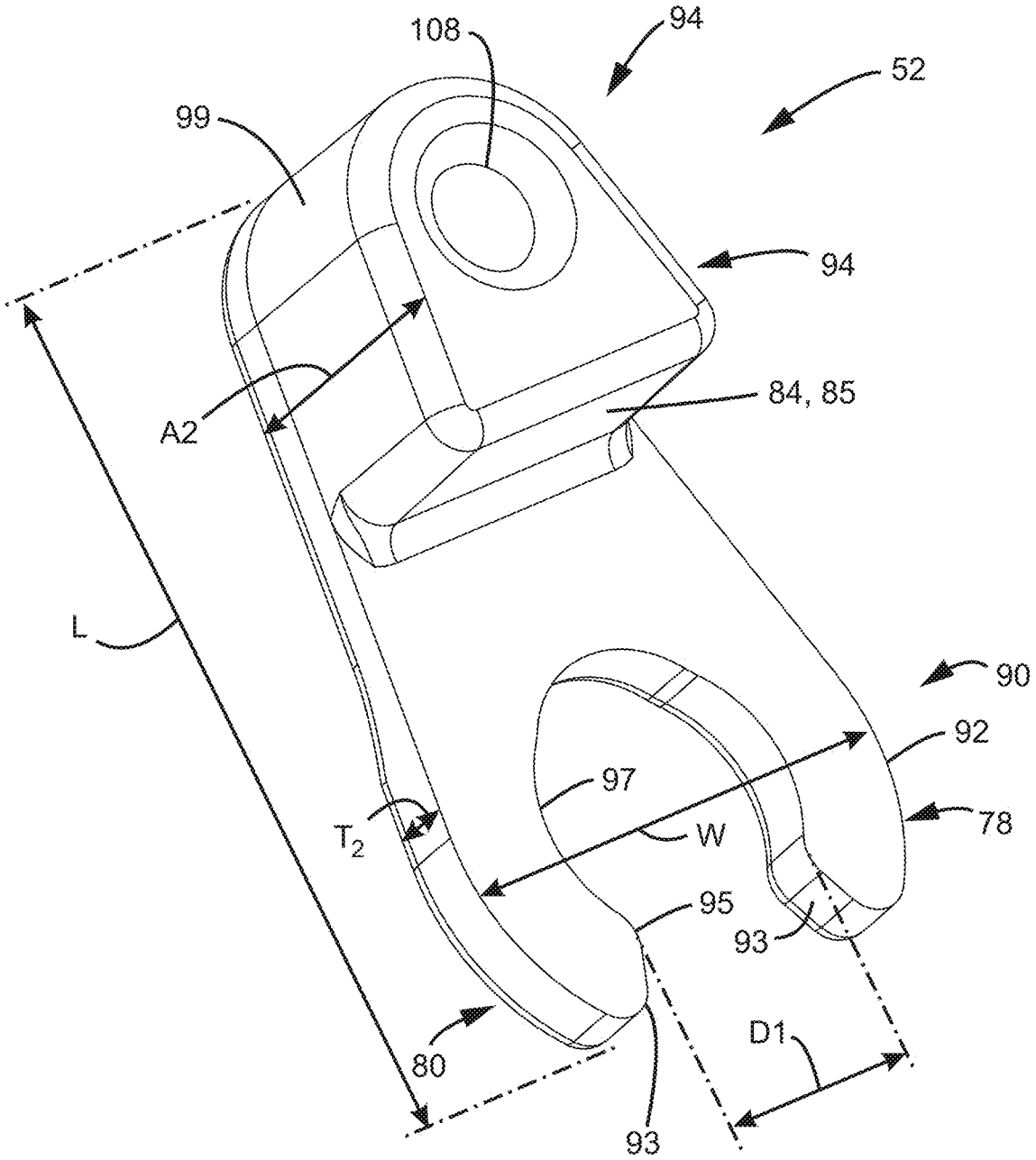
FIG. 6 is a isometric view of a spacer of the bow of FIG. 1.

Referring to FIG. 6, the spacer member 52 includes a first end portion 90. The first end portion 90 of the spacer member 52 includes a spacer snap-on portion 92 that defines the spacing thickness T2. The snap-on portion 92 includes opposed first and second axle retention arms 78, 80 that define a pocket 97 for receiving the axle shaft 40. In the depicted embodiment, the opposed axle retention arms 78, 80 include distal ends (e.g., free ends) that define an opening or gap 95 having a gap distance D1. In the depicted embodiment, the distance D1 is smaller than an outer diameter D2 (see FIG. 4) of the first axle shaft 40. In the depicted embodiment, the first and second arms 78, 80 flex to enable a snap engagement of the first spacer member 52 and the first axle shaft 40. In the depicted embodiment, the first and second arms 78, 80 elastically deflect when the spacer member 52 is driven radially into engagement with the axle shaft 40 until the first and second arms 78, 80 snap over the axle shaft 40. When the snap-on portion 92 is pushed radially against the outer surface of the axle shaft 40, angled surfaces 93 at the distal ends of the arms 78, 80 cause the arms 78, 80 to flex apart to widen the gap 95 to allow passage of the axle shaft 40 through the gap 95 and into the pocket 97. Once the axle shaft 40 passes through the gap 95, the arms 78, 80 elastically return (e.g., snap-back) to their non-flexed (e.g., non-deflected, non-deformed) state to capture the axle shaft 40 within the pocket 97. Thus, the spacer member 52 can be installed on the axle shaft 40 by radially inserting the spacer member 52 onto the axle shaft 40 thereby snapping the spacer member 52 onto the axle shaft 40. The spacer member 52 can be removed from the axle shaft 40 by pulling the spacer member 52 away from the axle shaft 40 in an outward radial direction causing the arms 78, 80 to flex apart to enlarge the gap 95 to a size where the axle shaft can pass through the gap 95. Once the shaft 40 passes through the gap, the arms 78, 80 elastically return to their non-flexed state in which the gap distance is D1.

In the depicted embodiment the first spacer member 52 includes a second end portion 94 connected to the first end portion 90. The spacer member 52 is elongate along a spacer length L that extends between the first and second end portions 90, 94. In one example, the spacer length L is at least 1.5 or 2.0 times as large as a width W of the spacer 52 measured at the snap-on portion. The width W is transverse with respect to the length and thickness of the spacer. The snap-on portion is defined at the first end portion 90 and a tool interface portion 99 is defined at the second end portion 94.

The tool interface portion 99 extends from the snap-on portion 92 in a direction along the length L of the spacer member 52 and has an axial thickness A2 that is thicker than the axial thickness T2 of the snap-on portion 92. When the spacer member 52 is mounted on the axle shaft 40, the axial thickness A2 as well as the thickness T2 are parallel to the axis 53 of the axle shaft 40 and therefore can be referred to as axial dimensions.

The tool interface portion 99 is adapted to couple with the tool 112 and can also be configured for preventing the spacer 52 from rotating about the axle shaft 40 relative to the limbs 18, 24. For example, the tool interface portion 99 can include an anti-rotation structure 84 (e.g., a shoulder, flat or other surface) for opposing a corresponding surface 88 (see FIG. 4) of an adjacent one of the limbs (e.g., limb 18) to prevent the spacer member 52 from rotating relative to the axle shaft 40. The anti-rotation structure 84 can include a surface 85 that extends in the axial orientation and is adapted to oppose the surface 88 when the axle assembly 30 is assembled with respect to the bow. In one example, the surface 88 faces toward a bow sight line 41 that extends through a central region of the bow. As so mounted, the open side of the spacer 52 (i.e., the side defining the gap 95) faces away from the sight line 41. Similarly, the surface 85 faces away from the sight line 41. Upon release of the bow string during a shot, the limbs 18, 24 move away from the sight line 41 and then rapidly decelerate to a stop. Hence, it is preferred for the spacer member 52 to be mounted such that the gap 95 faces away from the sight line 41 (upwardly in the case of the spacers used to space the limbs 18, 24 of the first limb assembly 17; downwardly in the case of the spacers used to space the limbs of the second limb assembly 19) such that upon rapid deceleration of the limbs 18, 24 during a shot the closed end of the pocket 97 is forced against the shaft 40 by inertia of the spacer member 52 such that contact between the axle shaft 40 and the closed end of the pocket 97 prevents the spacer member 52 from unintentionally disengaging from the axle shaft 40. Opposition between the surface 85 of the anti-rotation feature 84 and the surface 88 of the limb 18 provides a similar spacer retention function.

In one example, the limb sleeves 32, 36 are configured to interact with the axle shaft 40 and the first and second limbs 18, 24 to limit an amount the first and second limbs 18, 24 can be drawn together by the threaded fasteners 46, 48. In one example, the limb sleeves 32, 36 interact with the axle shaft 40 and the first and second limbs 18, 24 to prevent a spacing between the limbs 18, 24 from decreasing below a predetermined amount coordinated with the total spacing provided by each set of spacers 52, 54. In one example, the limb sleeves 32, 36 interact with the axle shaft 40 and the first and second limbs 18, 24 to prevent a spacing between the limbs 18, 24 from decreasing below an amount in which the axial space provided between the bearing assembly 72 and inner ends of the limb sleeves 32, 36 equals the total spacing provided by each set of spacers 52, 54. In one example, the limb sleeves 32, 36 interact with the axle shaft 40 and the first and second limbs 18, 24 to prevent a spacing between the limbs 18, 24 from decreasing below an amount in which axial load/thrust is applied to the bearing assembly 72 upon installation of the spacers 52, 54.

The limb sleeves 32, 36 each include a main sleeve body 105 having an axial inner end 101 and an axial outer end 103. The main sleeve body 105 can define a cylindrical outer surface and a cylindrical passage that extends between the inner and outer ends 101, 103. The main sleeve bodies 105 are received within the apertures 34, 38 of the limbs 18, 24. When assembled on the bow, the limb sleeves 32, 36 are aligned along the shaft axis 53 of the axle shaft 40 with opposite ends 107 of the axle shaft 40 being received within the limb sleeves 32, 36. The threaded fasteners 46, 48 extend through the outer ends 103 of the limb sleeves 32, 36 and thread into the internally threaded opposite ends 107 of the axle shaft 40. The heads 43 of the threaded fasteners 46, 48 oppose the outer lateral sides 33, 35 of the limbs 18, 14 such that when the fasteners 46, 48 are threaded into the ends 107 of the axle shaft 107, the limbs 18, 24 are drawn together to reduce an axial spacing between inner lateral sides 113, 115 of the limbs 18, 24. The limb sleeves 32, 36 each include a first stop 100 that opposes a corresponding one of the opposite ends 107 of the axle shaft 40. The limb sleeves 32, 36 also each including a second stop 104 that opposes an inner lateral side 113, 115 of a corresponding one of the first and second limbs 18, 24. In one example, the second stops 104 are defined by radial outer flanges (e.g., annular flanges) that project radially outwardly from main sleeve bodies 105 of the limb sleeves 32, 36 adjacent the axial inner ends 101. In one example, the radial outer flanges forming the stops 104 function as spacers between the first and second limbs 18, 24 and the bearing assembly 72. In one example, the first stops 100 are defined by radial inner flanges (e.g., annular flanges) that project radially inwardly from the main sleeve bodies 105 adjacent the axial outer ends 103 of the main sleeve bodies 105.

In one example, upon tightening of the threaded fasteners 46, 48, the ends of the axle shaft 40 bottom out in the limb sleeves 32, 36 by contacting the first stops 100 such that the limbs 18, 24 are prevented from being drawn together past a spacing limit established by the limb sleeves 32, 36. In the depicted embodiment, the sleeves 32, 36 prevent the ends 107 of the shaft 40 from contacting the heads 43 of the threaded fasteners 46, 48. In the depicted example, the limb sleeves 32, 36 retain the opposite ends 107 of the axle shaft 40 relative to the first and second limbs 18, 24 such that a spacing between the inner lateral sides 113, 115 of the first and second limbs 18, 24 and the opposite ends 107 of the axle shaft 40 does not exceed a predetermined spacing during tightening of the fasteners 46, 48. In one example, the predetermined spacing corresponds to axial lengths of the limb sleeves 32, 36, and a spacing is maintained between the ends 107 of the shaft 40 and the heads 43 of the fasteners 46, 48 during tightening. In one example, the limb sleeves 32, 36 prevent the spacing S7 between the axial inner ends 101 of the limb sleeves 32, 36 from decreasing below a dimension equal to the total spacing provided by one of the sets of spacers 52, 54 added to the axial dimension A1 of the bearing assembly 72. The axle assembly 30, by virtue of the interaction of the limb sleeves 32, 36 between the axle shaft 40 and the limbs 18, 24, is configured to limit an amount the limbs 18, 24 of the bow can be drawn together during assembly of the axle assembly 30 with respect to the bow. In certain examples, the configuration prevents thrust loading from being applied to the bearing 72 which supports the rotatable member 50 (e.g., a cam or pulley) on the axle shaft 40 of the axle assembly 30 or limits that amount of thrust load applied. In certain examples, the axle assembly 30 establishes a pre-determined axial spacing (i.e., a spacing measured along the axle shaft 40) between the first and second limbs 18, 24 when the axle assembly is fully tightened. In one example, the first spacer thickness and the second spacer thickness added together is corelated to the length of the axle minus the width of a bearing assembly and minus twice the inside length of limb sleeves that interface between the limbs and the axle.

Figure 7:
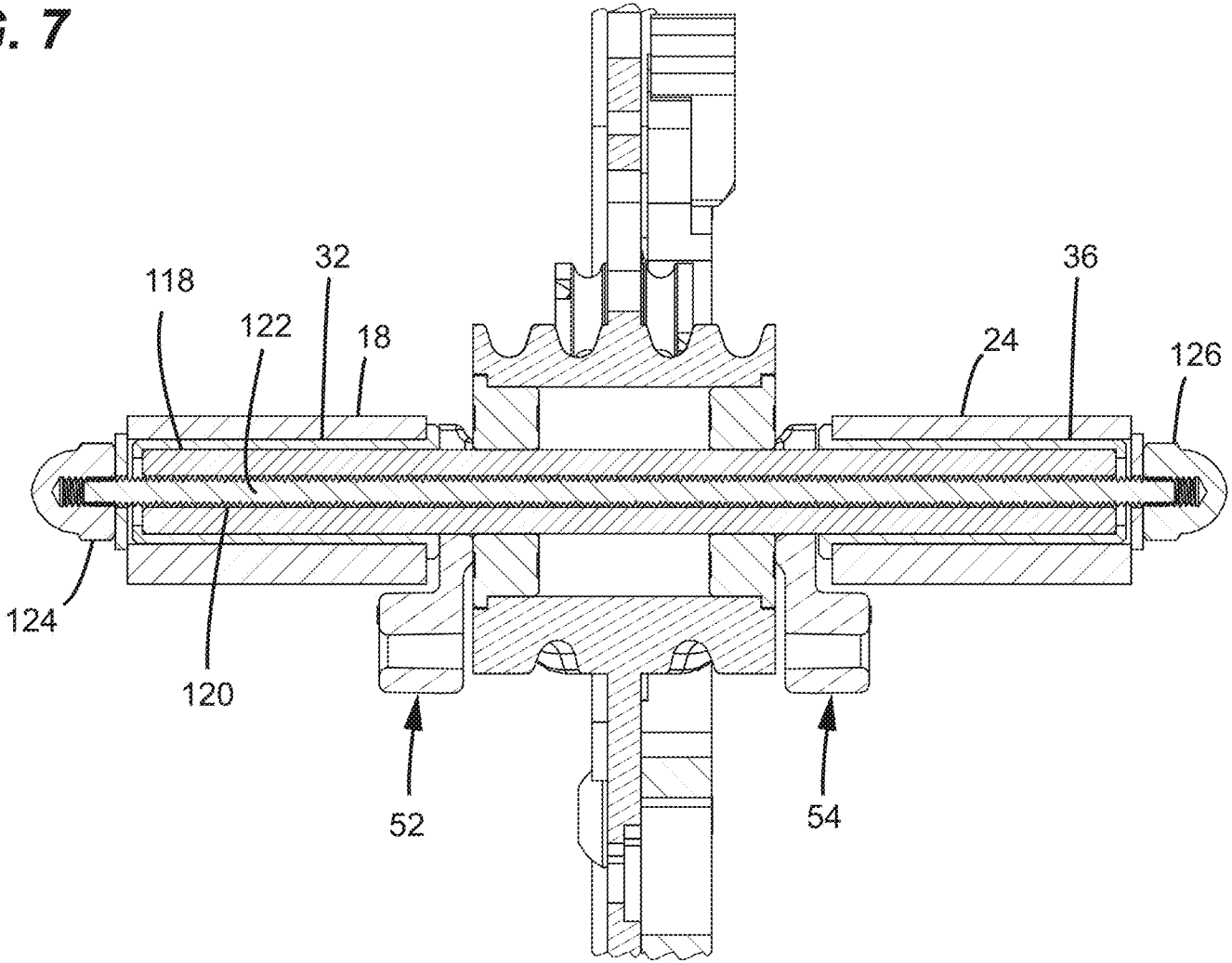
FIG. 7 is a cross sectional view of an alternative embodiment in accordance with the principles of the present disclosure.
Figure 8:
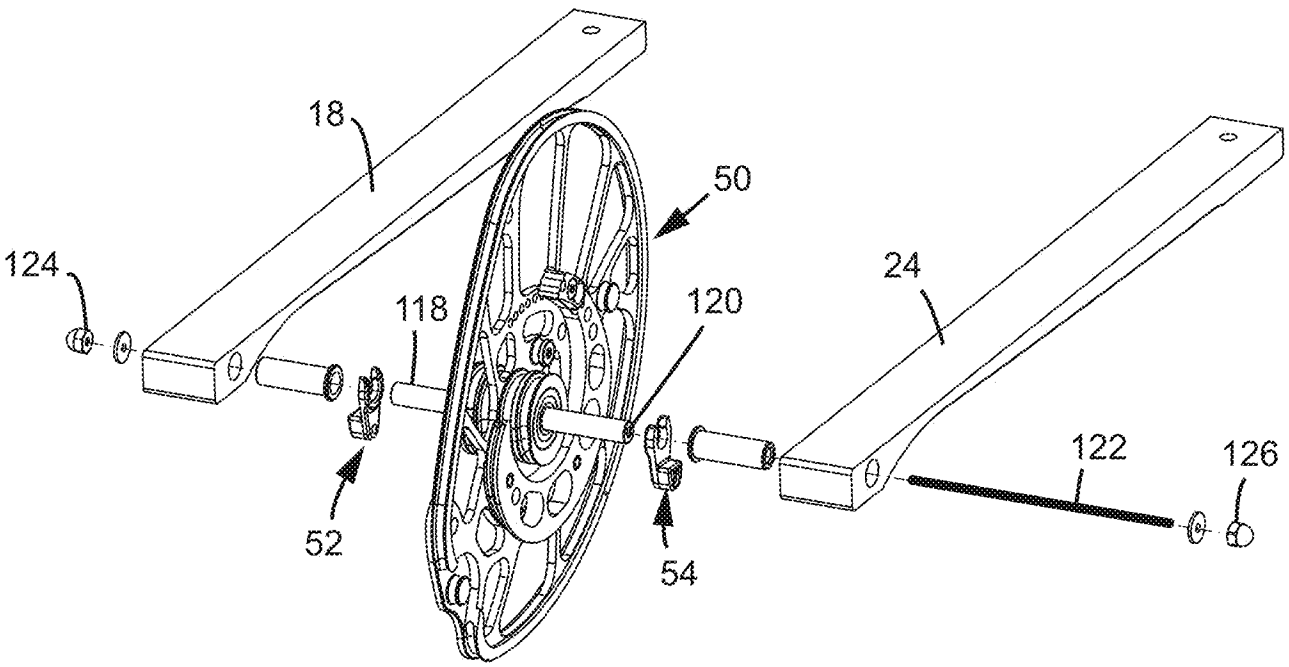
FIG. 8 is an exploded assembly view of the embodiment of FIG. 7.
Figure 9:
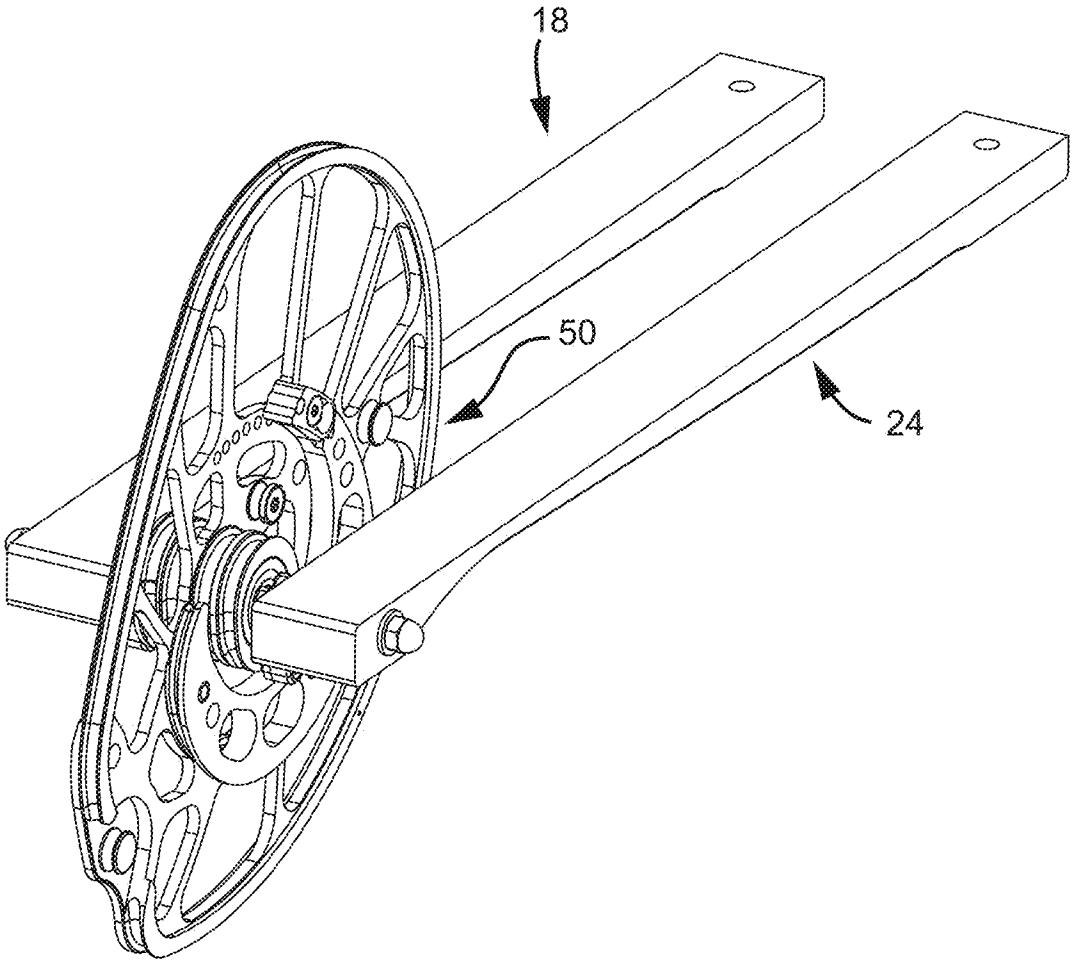
FIG. 9 is an isometric view of the embodiment of FIG. 7.

Referring to FIGS. 7-9, an alternative embodiment of the structure shown in FIGS. 2-5 is described herein in further detail. In the depicted embodiment an axle shaft 118 includes a through bore 120 that is configured to receive a threaded rod 122 that is configured to engage a first nut 124 (e.g., a cap nut) at a first end and a second nut 126 (e.g., a cap nut) at a second end. The structure of the depicted embodiment is otherwise similar to the structure previously described and illustrated in FIGS. 2-6. It should be appreciated that alternative configurations are possible. Limb sleeves 32, 36 limit the amount limbs 18, 24 can be drawn together during assembly of the axle assembly.

Figure 10:
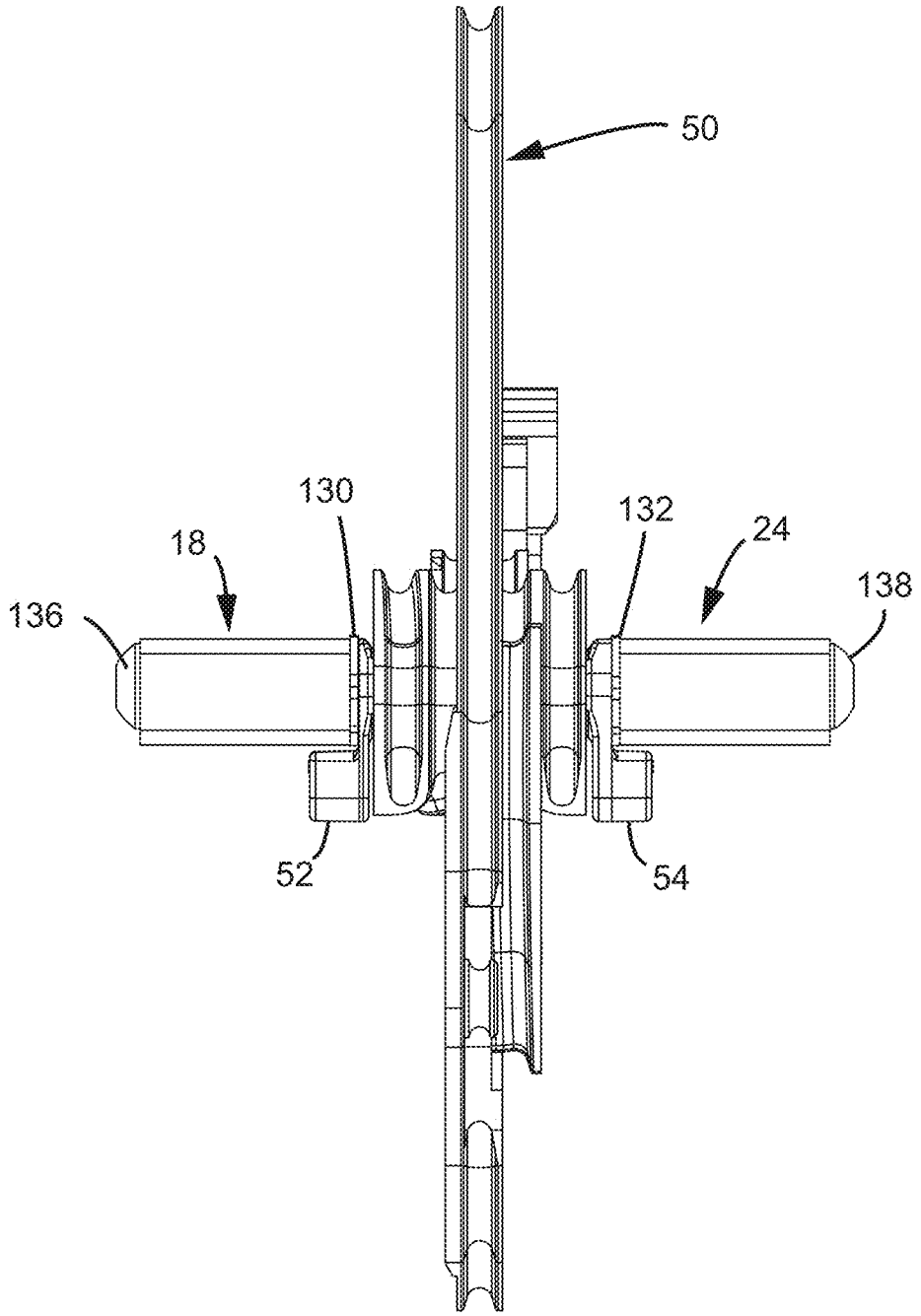
FIG. 10 is an end view of another alternative embodiment in accordance with the principles of the present disclosure.
Figure 11:
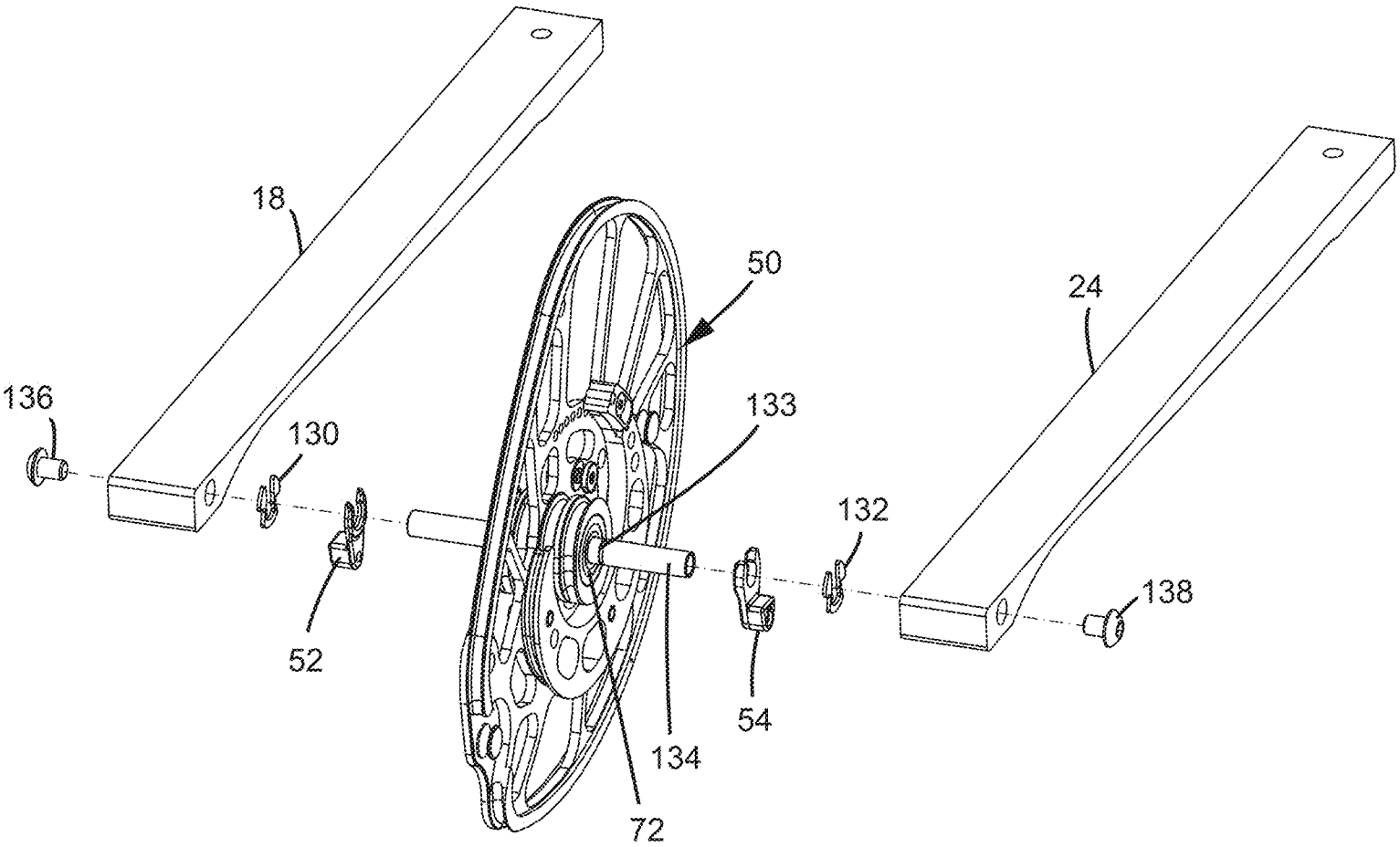
FIG. 11 is an exploded assembly view of the embodiment of FIG. 10.
Figure 12:
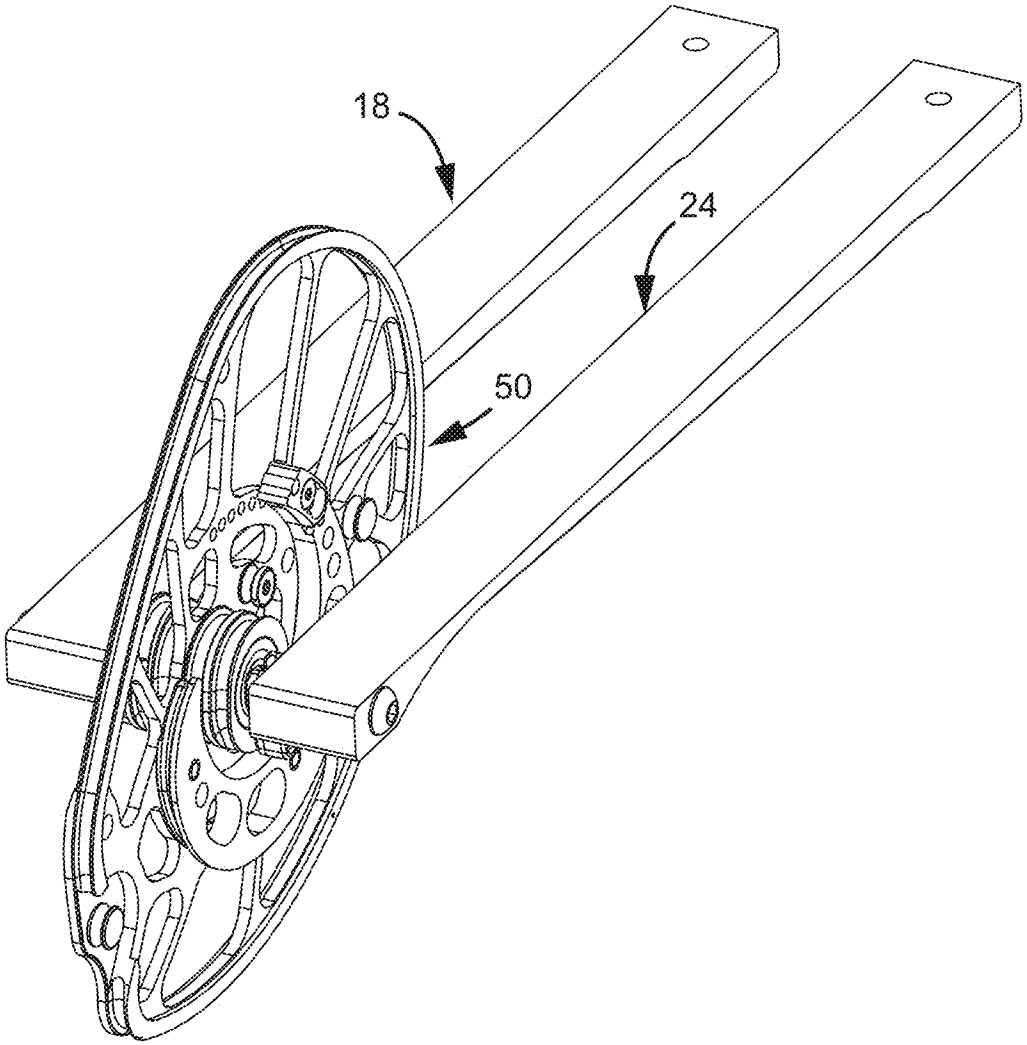
FIG. 12 is an isometric view of the embodiment of FIG. 10.
Figure 13:
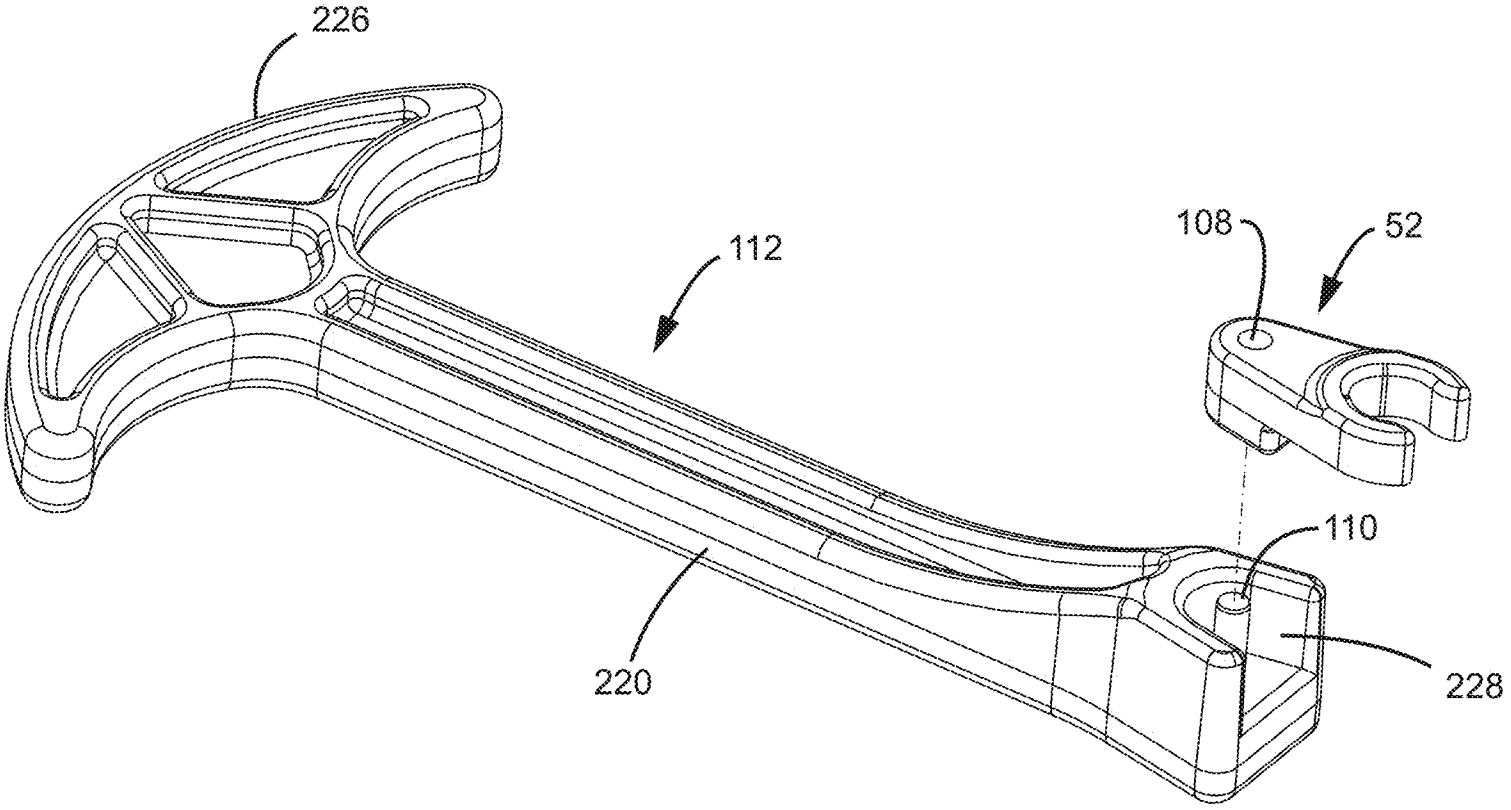
FIG. 13 is an isometric view of a spacer and spacer installation tool in a first position according to one embodiment of the bow tuning system of the present disclosure.
Figure 14:
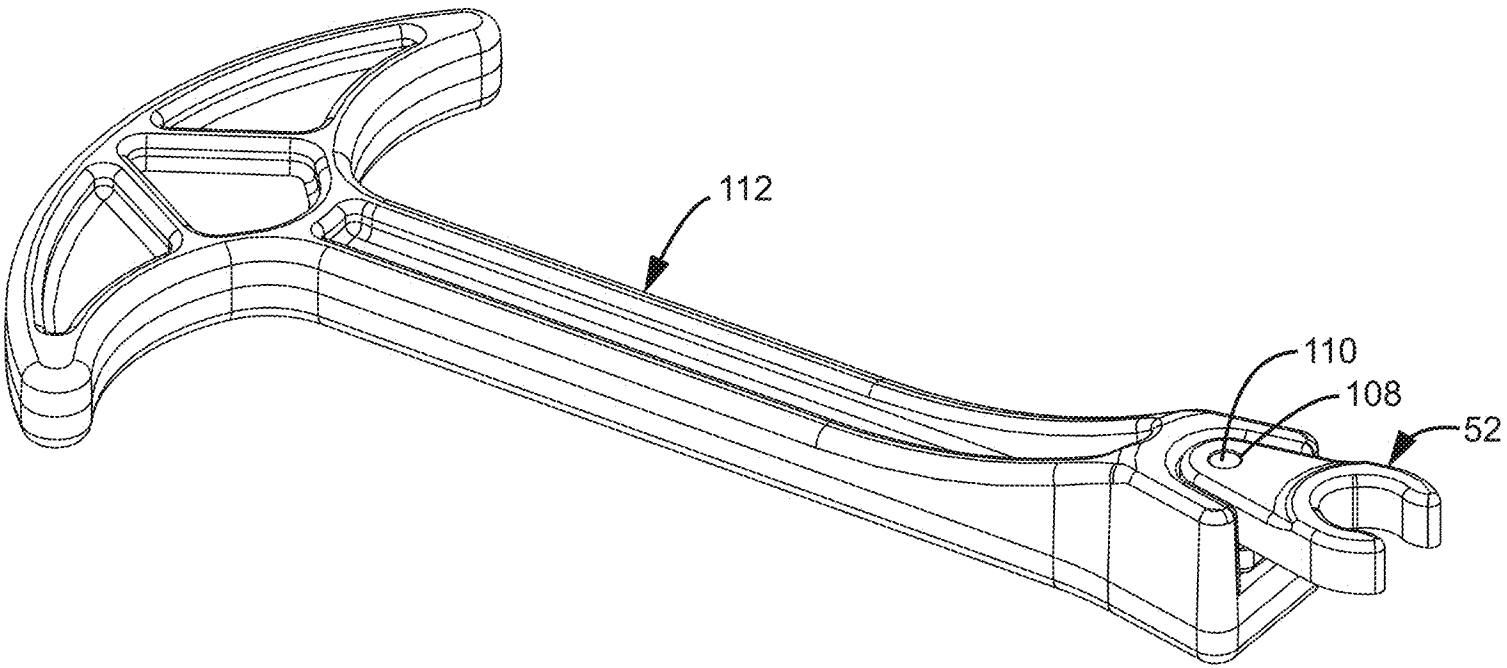
FIG. 14 is an isometric view of the spacer and spacer installation tool of FIG. 13 in a second position.
Figure 15:
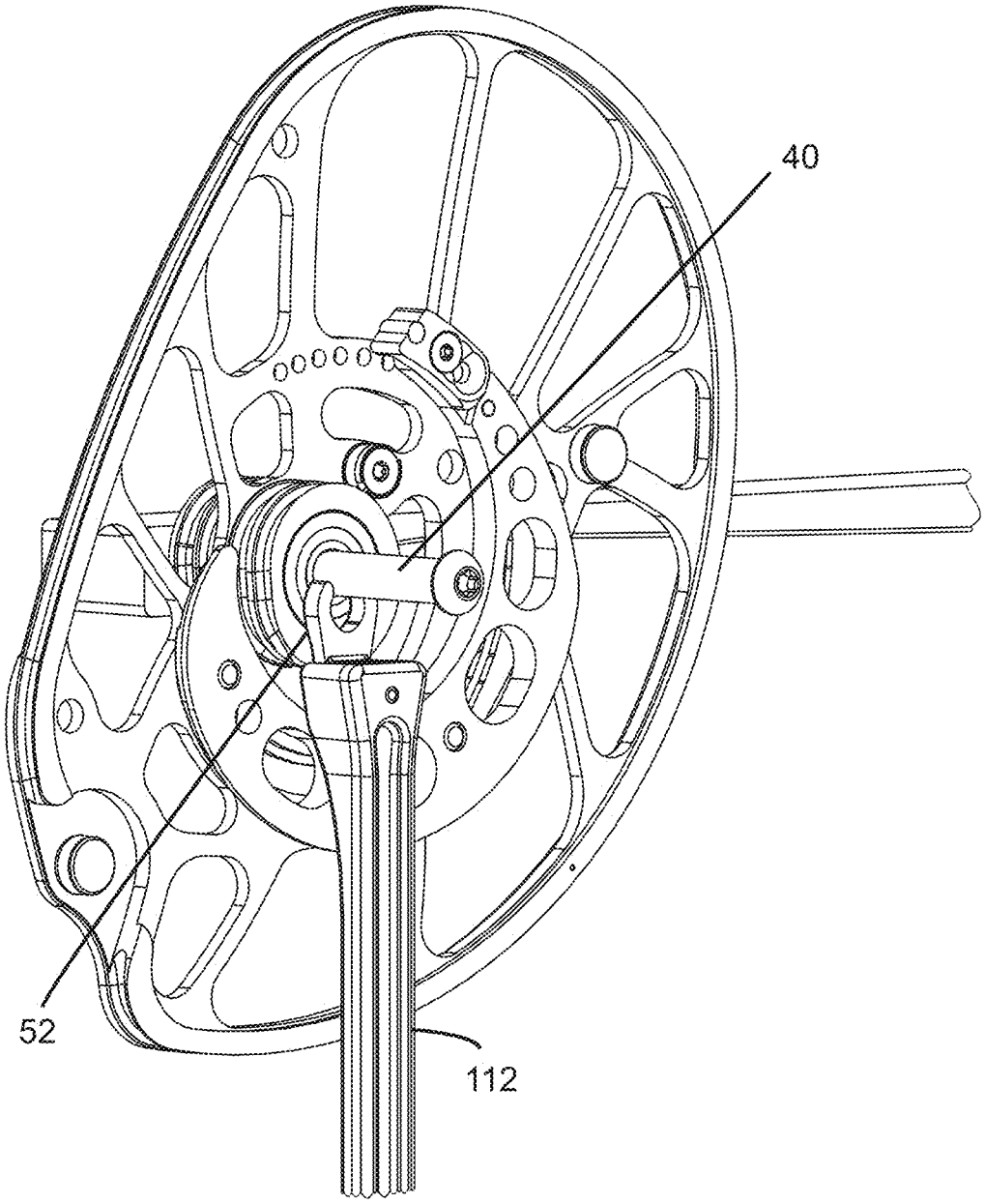
FIG. 15 is an isometric view of the spacer and spacer installation tool of FIG. 13 in a third position.
Figure 16:
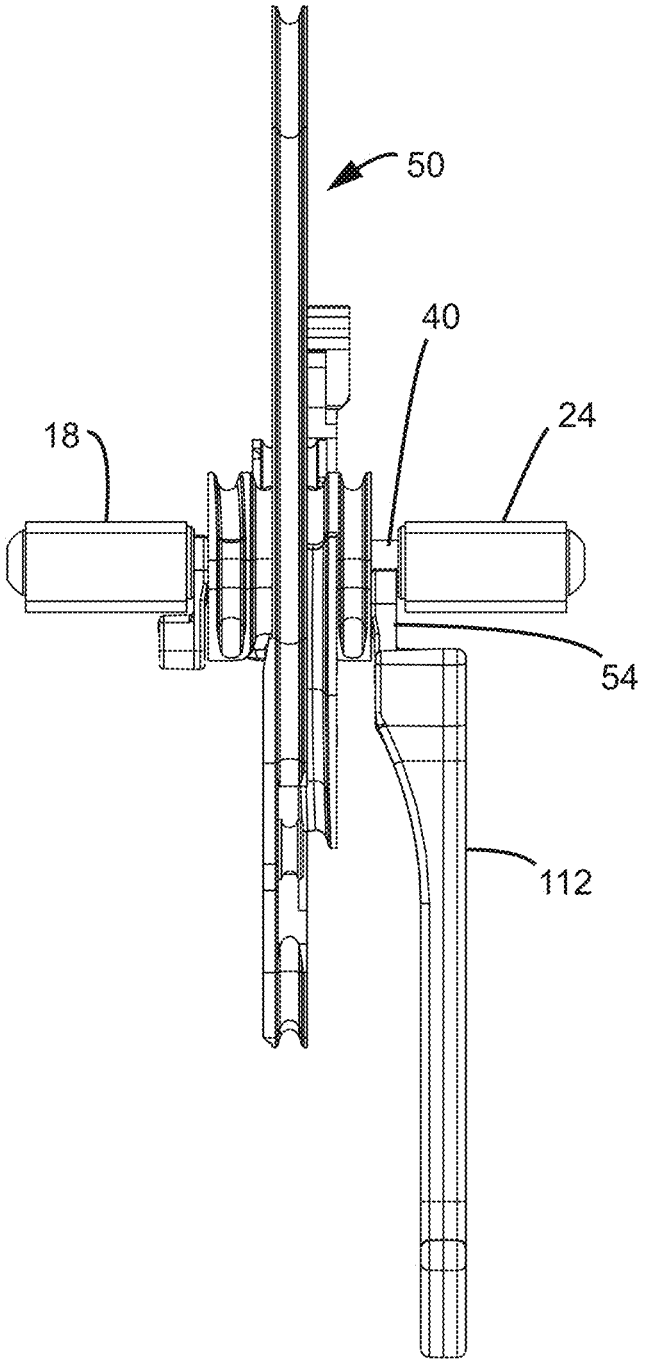
FIG. 16 is an end view of the spacer and spacer installation tool of FIG. 13 in the third position.
Figure 17:
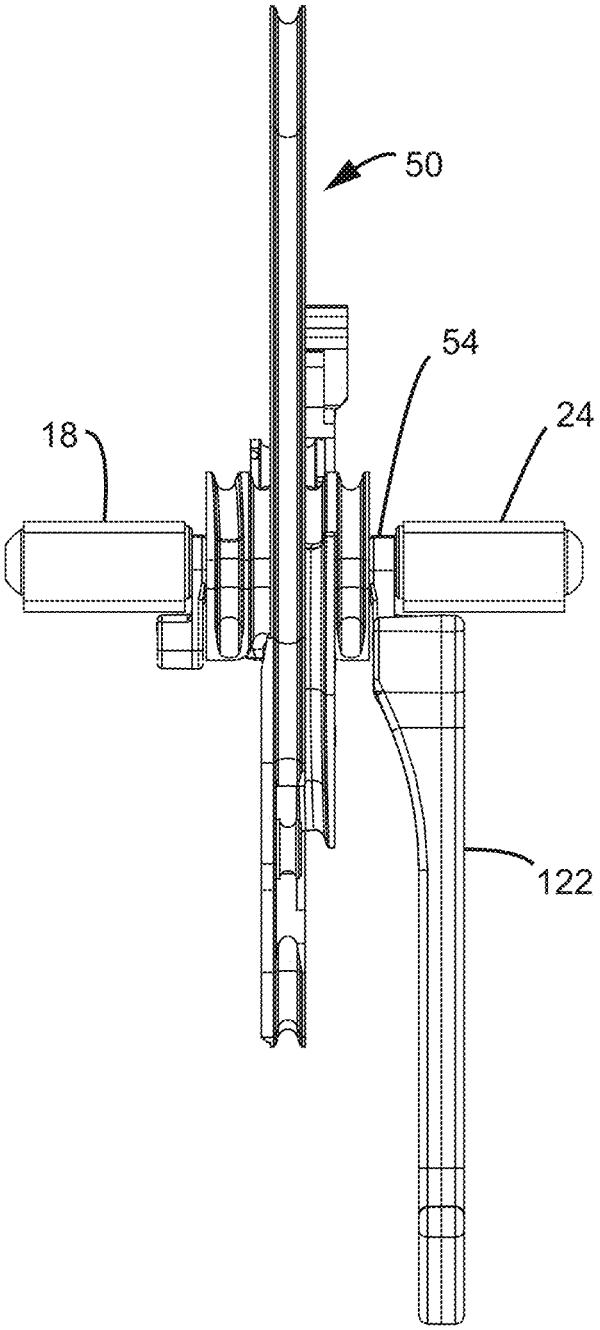
FIG. 17 is an end view of the spacer and spacer installation tool of FIG. 13 in a fourth position.

Referring to FIGS. 10-12, an alternative embodiment of the structure shown in FIGS. 2-5 is described herein in further detail. In the depicted embodiment stops such as spring clips 130, 132 are used to limit an amount the limbs can be drawn together along an axle shaft 134. In the depicted embodiment the spring clips 130, 132 engage grooves 133 in the axle shaft 134 on opposite sides of the bearing assembly 72 and function as stops for preventing the limbs from translating towards the center of the axle shaft 134 beyond the stops when fasteners 136, 138 are threaded into the ends the axle shaft 134. Thus, the clips 130, 132 limit an amount the first and second limbs of the bow can be drawn together during assembly of the axle assembly with respect to the bow to prevent thrust from being applied to the bearing assembly 72 by spacers 52, 54 mounted on the axle shaft 134 between clips 130, 132 and the bearing assembly 72. In this configuration, the sleeves described above and shown in FIGS. 2-9 are not used. It should be appreciated that alternative configurations are possible.

Referring to FIGS. 13-17, the spacer 52 is configured to be inserted radially onto the axle shaft 40 and pulled radially from the axle shaft 40 using the tool 112. The tool 112 is configured to apply a pushing force through the length of the spacer 52 to snap the spacer 52 radially onto the axle shaft 40. The tool 112 is also configured to apply a pulling force through the length of the spacer 52 for disengaging the spacer 52 from the axle shaft 40. The tool includes a tool body 220 having a tool length that extends between first and second ends 222, 224. A handle 226 is provided at the first end 222 and a pocket 228 is defined at the second end 224. In the depicted embodiment, the second end portion 94 (e.g., the tool interface portion 99 of the spacer 52) includes a spacer installation tool engagement interface. In the depicted embodiment the spacer installation tool engagement interface includes an aperture 108 (see FIG. 6) that is configured to receive a boss 110 within the pocket 228 of the spacer installation tool 112. The aperture 108 has a length that is parallel to the axis 53 of the axle shaft 40 when the spacer 52 is mounted on the axle shaft 40 and therefore can be referred to as an axial direction. The tool interface portion 99 also includes an outer shape (e.g., a curved end) that matches a shape of the pocket 228. The second end portion 94 of the spacer is loaded into the pocket 228 and over the boss 110 by inserting the spacer 52 into the pocket 228 in a direction transverse with respect to the length of the tool body 220 (i.e., an axial direction). During insertion, the boss 110 is received in the aperture 108 in an axial direction. Similarly, the tool 112 can be disengaged from the spacer 52 after snapping the spacer 52 over the axle shaft 40 by translating the tool 112 in an axial direction such the boss 110 slides axially out of the aperture 108 and the second end portion 94 slides axially out of the pocket 228.

The spacer installation tool 112 is configured to hold the spacer member 52 and transfer a radial force on the spacer member 52 to facilitate the installation and removal of the spacer 52 with respect to the axle shaft 40. In the depicted embodiment the spacer installation tool 112 releases from the spacer member 52 when the tool is translated from the spacer member 52 in a direction along the aperture 108 and boss 110. In use, this direction is parallel to an axis of the axle shaft 40 and can be referred to as an axial direction. The spacer installation tool of the depicted embodiment facilitates the installation and removal of the spacers as it enables the person tuning the bow to impart a large amount of force on the spacers in a controlled manner. The handle of the installation tool is large and ergonomic and the engagement between the installation tool and the spacer is one that the degrees of freedom of the spacer is constrained when engaged with the tool, yet the spacer can easily be release from the tool. In a preferred example, the tool 112 does not apply clamping force to the spacers during use. Instead, the spacers slide into a complementary structure defined by the tool. It should be appreciated that other configurations are also possible. In use, the snap-on portions of the spacers are located outside the pocket 228 of the tool 112 such that the tool does not interfere with deflection of the elastic arms 78, 80. In one example, the spacers have a mated relationship with respect to the tool 112 when engaged with the tool 112.

FIGS. 20-23 depict another axle assembly 330 in accordance with the principles of the present disclosure that does not include snap-on spacers. The axle assembly 330 incudes an axle shaft 40 for rotatably supporting a rotatable member 50 (e.g., a cam or pulley) between first and second limbs 18, 24 of a bow. The rotatable member 50 is adapted to engage a bow string routed about a periphery of the rotatable member 50 as shown at FIG. 1. The rotatable member 50 is rotatably supported on the axle shaft 40 by bearing assembly 72. Ends of the axle shaft 40 fit within a set of limb sleeves 332, 336 that install within apertures 34, 38 defined by the limbs 18, 24. The limb sleeves 332, 336 include flanges 337, 339 that function as spacers for spacing the bearing assembly at a desired position between the limbs 18, 24. The flanges 337, 339 can have different axial spacing thicknesses to offset the rotatable member from a centered position between the limbs 18, 24. To vary the offset position of the rotatable member 50, a different set of limb sleeves can be used having different axial spacings than the set of limb sleeves 332, 336. Similar to the limb sleeves 32, 36, the limb sleeves 332, 336 have radially inwardly extending stops 341 that oppose ends of the shaft 40 such that the sleeves 332, 336 are configured to interact with the axle shaft 40 and the first and second limbs 18, 24 to limit an amount the first and second limbs 18, 24 can be drawn together by the threaded fasteners 46, 48.

As discussed above, the present disclosure also provides a method of tuning a bow. In one embodiment the method includes the step of providing a first spacer member that includes a first end portion and a second end portion, the first end portion of the spacer member including a spacer body portion that defines a first spacing thickness, the first end portion including opposed axle retention arms that extend from the spacer body portion, the opposed axle retention arms including distal ends that define one opening that is smaller than a diameter of an axle shaft, wherein the axle retention arms are configured to elastically deflect and snap over the axle shaft when driven with force into engagement with the axle shaft.

The method can also include the step of providing a spacer installation tool that is configured to engage the second end portion of the first spacer.

The method of the present disclosure can also include the step of engaging the first spacer with the spacer installation tool and using the tool to drive the spacer into engagement with the axle shaft, wherein the step of driving the spacer into engagement of the axle shaft includes applying a radial force on the spacer that causes the axle retention arms to deflect and snap over the axle shaft.

The method according to some embodiments of the present disclosure may also include the step of disengaging the spacer installation tool from the spacer by sliding the spacer installation tool in an axial direction relative to the spacer.

The method according to some embodiments of the present disclosure may also include the step of selecting a second spacer that has a different spacing size relative to the first spacer.

The method according to some embodiments of the present disclosure includes the step of installing the first spacer. The step is accomplished without disassembling the bow while both ends of the axle remain secured to the limbs of the bow.

In should be appreciated the above description is not meant to be limiting. The above description relates to several embodiments of the invention. Many other embodiments are possible.

We claim:

1. A spacer kit for an archery bow having a rotatable member rotatably supported on an axle that extends between a pair of limbs of the bow, the spacer kit comprising:

a first and second spacer each including:

a spacer member having first end portion and a second end portion, the spacer member being elongate along a length that extends between the first and second end portions, the first end portion including a snap-on portion, the snap-on portion including opposed axle retention arms including free ends that define an opening that is smaller than a diameter of the axle, the axle retention arms being configured to elastically deflect and snap over the axle when driven radially into engagement with the axle, and the second end portion defining a tool interface portion for coupling with an installation tool;

the snap-on portion of the spacer member of the first spacer having a first spacing thickness and the snap-on portion of the spacer member of the second spacer having a second spacing thickness different than the first spacing thickness.

2. The spacer kit of claim 1, wherein the second end portion of each spacer member includes a shoulder configured to engage one of the limbs to limit rotation of the spacer member.

3. The spacer kit of claim 1, further comprising a first limb sleeve and a second limb sleeve, each of the first and second limb sleeves having an aperture configured to receive opposite ends of the axle, wherein each of the first and second limb sleeves includes an outward surface configured to engage apertures in the pair of limbs, wherein each of the first and second limb sleeves includes a first end with an inwardly extending radial flange and a second end including an outwardly extending radial flange, wherein the inwardly extending radial flanges abut the opposite ends of the axle and the outwardly extending radial flange abut inner side surfaces of the pair of limbs.

4. The spacer kit of claim 1, further comprising third and fourth spacers respectively having third and fourth spacing thicknesses that are different from each other and that are different from the first and second spacing thicknesses, wherein a sum of the first and second spacing thicknesses equals a sum of the third and fourth spacing thicknesses.

5. The spacer kit of claim 1, wherein the first and second spacers are configured such that the openings defined by the retention arms face away from a sight line of the bow when the first and second spacers are mounted on the axle.

6. An archery bow comprising:

a riser:

a first and second limbs coupled with the riser;

a rotatable member;

an axle assembly including:

an axle shaft that extends between the first and second limbs along a shaft axis, the rotatable member being supported on the axle shaft by a bearing assembly;

a first spacer secured to the axle shaft between the bearing assembly and the first limb; and a second spacer secured to the axle shaft between the bearing assembly and the second limb, the first and second spacers each having a snap-on construction for allowing the first and second spacers to be radially snapped onto the axle shaft;

wherein the first and second spacers have anti-rotation features to prevent rotation of the first and second spacers about the axle shaft relative to the first and second limbs, wherein the anti-rotation feature of the first spacer opposes a portion of the first limb and the anti-rotation feature of the second spacer opposes a portion of the second limb.

7. The archery bow of claim 6, wherein the anti-rotation features include shoulders.

8. The archery bow of claim 7, wherein surfaces of the shoulders of the anti-rotation features extend in an axial orientation and are adapted to oppose surfaces of the limbs.

9. The archery bow of claim 6, wherein the first and second spacers each have a first end portion and a second end portion, the first and second spacers being elongate along lengths that extend between the first and second end portions, the first end portions including snap-on portions, the snap-on portions including opposed axle retention arms including free ends that define an opening that is smaller than a diameter of the axle shaft, the axle retention arms being configured to elastically deflect and snap over the axle shaft when driven radially into engagement with the axle shaft, and the second end portion defining a tool interface portion for coupling with an installation tool.

10. The archery bow of claim 9, wherein the first and second spacers are mounted on the axle shaft such that the openings face away from a sight line of the bow.

11. The archery bow of claim 6, further comprising limb sleeves received in apertures defined by the first and second limbs, the limb sleeves being aligned along the shaft axis with the opposite ends of the axle shaft being received within the limb sleeves, the limb sleeves each including a first stop that opposes a corresponding one of the opposite ends of the axle shaft, the limb sleeves also each including a second stop that opposes an inner side of a corresponding one of the first and second limbs.

12. The archery bow of claim 6, further comprising axial stop clips snapped within grooves defined by the axle shaft, the axial stop clips including a first axial stop clip positioned between the first spacer and the first limb and a second axial stop clip positioned between the second spacer and the second limb.

13. The archery bow of claim 6, further comprising a rod that extends axially though the axle shaft and through the first and second limbs, the rod having threaded ends that project beyond the first and second limbs, wherein nuts are threaded on the threaded ends to draw the first and second limbs together.

14. An archery bow comprising:

a riser:

a first and second limbs coupled with the riser;

a rotatable member;

an axle assembly including:

an axle shaft that extends between the first and second limbs along a shaft axis, the axle shaft having opposite ends, the rotatable member being supported on the axle shaft by a bearing assembly;

limb sleeves received in apertures defined by the first and second limbs, the limb sleeves being aligned along the shaft axis with the opposite ends of the axle shaft being received within the limb sleeves, the limb sleeves each including a first stop that opposes a corresponding one of the opposite ends of the axle shaft, the limb sleeves also each including a second stop that opposes an inner side of a corresponding one of the first and second limbs; and a threaded fastening arrangement for securing the axle shaft to the first and second limbs, the threaded fastening arrangement including threaded fasteners located at outer sides of the first and second limbs that are turned to draw the first and second limbs toward each other, wherein the limb sleeves interact with the axle shaft and the first and second limbs to limit an amount the first and second limbs can be drawn together.

15. The archery bow of claim 14, wherein the second stops are defined by outer flanges that project radially outwardly from main sleeve bodies of the limb sleeves.

16. The archery bow of claim 15, wherein the outer flanges function as spacers between the first and second limbs and the bearing assembly.

17. The archery bow of claim 15, wherein the first stops are defined by inner flanges that project radially inwardly from the main sleeve bodies.

18. The archery bow of claim 14, further comprising snap-on spacers that mount on the axle shaft between the outer flanges of the limb sleeves and the bearing assembly, the snap-on spacers being radially installable on and radially removeable from the axle shaft.

19. An archery bow comprising:

a riser:

a first and second limbs coupled with the riser;

a rotatable member;

an axle assembly including:

an axle shaft that extends between the first and second limbs along a shaft axis, the axle shaft having opposite ends, the rotatable member being supported on the axle shaft by a bearing assembly;

stop clips snapped within grooves defined by the axle shaft on opposite sides of the bearing assembly to limit an amount the first and second limbs can be drawn together;

spacers positioned on the axle shaft on opposite sides of the bearing assembly between the stop clips and the bearing assembly; and a threaded fastening arrangement for securing the axle shaft to the first and second limbs, the threaded fastening arrangement including threaded fasteners located at outer sides of the first and second limbs that are turned to draw the first and second limbs toward each other.

20. A method of installing a spacer on an axle of a bow, the spacer including a first end portion and a second end portion, the first end portion of the spacer defining a first spacing thickness, the first end portion including opposed axle retention arms, the opposed axle retention arms including distal ends that define an opening that is smaller than a diameter of the axle, wherein the axle retention arms are configured to elastically deflect and snap over the axle when the spacer is driven radially onto the axle, the second end portion of the spacer defining a tool engagement portion including an axial aperture adapted to receive a boss of an installation tool, the method comprising:

mating the second end portion of the spacer with a spacer installation tool, wherein the first end portion protrudes from the spacer installation tool when the spacer is mated with the spacer installation tool; and using the spacer installation tool to drive the spacer radially onto the axle.

21. The method of claim 20, further comprising the step of disengaging the spacer installation tool from the spacer while the spacer remains on the axle by sliding the spacer installation tool relative to the spacer in an axial direction along the axle.

22. A spacer kit for an archery bow having a rotatable member rotatably supported on an axle that extends between a pair of limbs of the bow, the spacer kit comprising:

a first and second spacer each including:

a spacer member having first end portion and a second end portion, the spacer member being elongate along a length that extends between the first and second end portions, the first end portion including a snap-on portion, the snap-on portion including opposed axle retention arms including free ends that define an opening that is smaller than a diameter of the axle, the axle retention arms being configured to elastically deflect and snap over the axle when driven radially into engagement with the axle, and the second end portion defining a tool interface portion for coupling with an installation tool;

the snap-on portion of the spacer member of the first spacer having a first spacing thickness and the snap-on portion of the spacer member of the second spacer having a second spacing thickness different than the first spacing thickness; and the tool interface portion of each spacer member including an axial aperture adapted to receive a boss of the installation tool.

23. The spacer kit of claim 22, further comprising the installation tool, wherein the boss is located within a pocket of the installation tool which is configured for receiving the second end portion of each spacer member.

24. A spacer kit for an archery bow having a rotatable member rotatably supported on an axle that extends between a pair of limbs of the bow, the spacer kit comprising:

a first and second spacer each including:

a spacer member having first end portion and a second end portion, the spacer member being elongate along a length that extends between the first and second end portions, the first end portion including a snap-on portion, the snap-on portion including opposed axle retention arms including free ends that define an opening that is smaller than a diameter of the axle, the axle retention arms being configured to elastically deflect and snap over the axle when driven radially into engagement with the axle, and the second end portion defining a tool interface portion for coupling with an installation tool;

the snap-on portion of the spacer member of the first spacer having a first spacing thickness and the snap-on portion of the spacer member of the second spacer having a second spacing thickness different than the first spacing thickness; and the installation tool, wherein the installation tool is configured to retain each spacer member and transfer a radial force through each spacer member to facilitate the installation and removal of each spacer member with respect to the axle, and wherein the installation tool releases from each spacer member when the installation tool is translated from spacer members in a direction along the axle.

25. The spacer kit of claim 24, wherein the installation tool does not clamp the spacer members during installation or removal of the spacer members with respect to the axle.

26. An archery bow comprising:

a riser:

a first and second limbs coupled with the riser;

a rotatable member; and an axle assembly including:

an axle shaft that extends between the first and second limbs along a shaft axis, the rotatable member being supported on the axle shaft by a bearing assembly;

a first spacer secured to the axle shaft between the bearing assembly and the first limb; and a second spacer secured to the axle shaft between the bearing assembly and the second limb, the first and second spacers each having a snap-on construction for allowing the first and second spacers to be radially snapped onto the axle shaft;

wherein the first and second spacers have anti-rotation features to prevent rotation of the first and second spacers about the axle shaft relative to the first and second limbs, wherein the anti-rotation feature of the first spacer opposes a portion of the first limb and the anti-rotation feature of the second spacer opposes a portion of the second limb;

wherein the first and second spacers each have a first end portion and a second end portion, the first and second spacers being elongate along lengths that extend between the first and second end portions, the first end portions including snap-on portions, the snap-on portions including opposed axle retention arms including free ends that define an opening that is smaller than a diameter of the axle shaft, the axle retention arms being configured to elastically deflect and snap over the axle shaft when driven radially into engagement with the axle shaft, and the second end portion defining a tool interface portion for coupling with an installation tool; and wherein the tool interface portions define axial apertures for receiving a boss of the installation tool.

* * * * *